US008494865B2

(12) United States Patent
Fuchs et al.

(10) Patent No.: US 8,494,865 B2
(45) Date of Patent: Jul. 23, 2013

(54) AUDIO DECODER, AUDIO ENCODER, METHOD FOR DECODING AN AUDIO SIGNAL, METHOD FOR ENCODING AN AUDIO SIGNAL, COMPUTER PROGRAM AND AUDIO SIGNAL

(75) Inventors: Guillaume Fuchs, Erlangen (DE); Markus Multrus, Nuremberg (DE); Ralf Geiger, Erlangen (DE); Arne Borsum, Erlangen (DE); Frederik Nagel, Nuremberg (DE); Julien Robilliard, Nuremberg (DE); Vignesh Subbaraman, Erlangen (DE); Jeremie Lecomte, Fuerth (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/081,241

(22) Filed: Apr. 6, 2011

(65) Prior Publication Data

US 2011/0238426 A1 Sep. 29, 2011

Related U.S. Application Data

(63) Continuation of application No. PCT/EP2009/007169, filed on Oct. 6, 2009.

(60) Provisional application No. 61/103,820, filed on Oct. 8, 2008.

(51) Int. Cl.
*G10L 19/00* (2006.01)

(52) U.S. Cl.
USPC ..... 704/500

(58) Field of Classification Search
USPC ..... 704/500
See application file for complete search history.

(56) References Cited

U.S. PATENT DOCUMENTS 5,898,605 A 4/1999 Smarandoiu et al.
6,081,783 A * 6/2000 Divine et al. ..... 704/500

(Continued)

FOREIGN PATENT DOCUMENTS

JP 2005223533 A 8/2005
JP 2006279333 A 10/2006

(Continued)

OTHER PUBLICATIONS

Yu R. et al: "MPEG-4 Scalable to Lossless Audio Coding", 117th AES Convention, Oct. 31, 2004, p. 1-14, XP040372512.

(Continued)

*Primary Examiner* — Jakieda Jackson
(74) *Attorney, Agent, or Firm* — Michael A. Glenn; Glenn Patent Group

(57) ABSTRACT

An audio decoder for providing a decoded audio information on the basis of an entropy encoded audio information includes a context-based entropy decoder configured to decode the entropy-encoded audio information in dependence on a context, which context is based on a previously-decoded audio information in a non-reset state-of-operation. The context-based entropy decoder is configured to select a mapping information, for deriving the decoded audio information from the encoded audio information, in dependence on the context. The context-based entropy decoder includes a context resetter configured to reset the context for selecting the mapping information to a default context, which default context is independent from the previously-decoded audio information, in response to a side information of the encoded audio information.

19 Claims, 29 Drawing Sheets

U.S. PATENT DOCUMENTS

| | | | | |
|---|---|---|---|---|
| 6,680,972 | B1 | 1/2004 | Liljeryd et al. | |
| 6,978,236 | B1 | 12/2005 | Liljeryd et al. | |
| 8,015,368 | B2 | 9/2011 | Sharma et al. | |
| 2002/0118845 | A1 | 8/2002 | Henn et al. | |
| 2004/0078205 | A1 | 4/2004 | Liljeryd et al. | |
| 2004/0125878 | A1 | 7/2004 | Liljeryd et al. | |
| 2004/0131203 | A1 | 7/2004 | Liljeryd et al. | |
| 2004/0138876 | A1 | 7/2004 | Kallio et al. | |
| 2004/0174911 | A1 | 9/2004 | Kim et al. | |
| 2004/0260545 | A1 | 12/2004 | Gao et al. | |
| 2005/0096917 | A1 | 5/2005 | Kjorling et al. | |
| 2005/0177360 | A1 | 8/2005 | Skhejers et al. | |
| 2005/0246164 | A1 | 11/2005 | Ojala et al. | |
| 2007/0016427 | A1* | 1/2007 | Thumpudi et al. | 704/500 |
| 2007/0106503 | A1 | 5/2007 | Kim et al. | |
| 2007/0299656 | A1 | 12/2007 | Son et al. | |
| 2011/0173006 | A1 | 7/2011 | Nagel et al. | |
| 2012/0069899 | A1* | 3/2012 | Mehrotra et al. | 375/240.03 |

FOREIGN PATENT DOCUMENTS

| | | |
|---|---|---|
| RU | 2204176 | 5/2003 |
| RU | 2257556 | 7/2005 |
| RU | 2325046 | 5/2008 |
| WO | 9857436 | 12/1998 |
| WO | 02052545 | 7/2002 |
| WO | 2004044894 | 5/2004 |
| WO | WO-2005093717 | 10/2005 |
| WO | WO2010/003479 A1 | 1/2010 |

OTHER PUBLICATIONS

Meine N. et al: "Improved Quantization and Lossless Coding for Subband Audio Coding" 118$^{th}$ AES Convention, vol. 1-4, May 31, 2005, p. 1-9, XP040507276.

Marpe D. et al.: Context-based adaptive binary arithmetic coding in the H.264/AVC video compression standard:, IEEE Transactions on Circuits and Systems for Video Technology, vol. 13, No. 7, Jul. 1, 2003, p. 620-636, XP011099255.

Hsu, H et al., "Audio Patch Method in MPEG-4 HE-AAC Decoder", Presented at the 117th AES Convention. San Francisco, CA, USA., Oct. 28, 2004, 1-11.

Wolters, M et al., "A Closer Look into MPEG-4 High Efficiency AAC", Preprints of Papers Presented at the 115th AES Convention. vol. 115. XP008063876., Oct. 10, 2003, 16 Pages.

* cited by examiner

FIG 3A

Sytax of fd_channel_stream()

| | Syntax | No. of bits | Mnemonic |
|---|---|---|---|
| | fd_channel_stream(common_window, common_tw, noiseFilling) | | |
| | { | | |
| | global_gain; | 8 | uimsbf |
| optional noise filling information | if (noiseFilling) { | | |
| | noise_offset | 3 | uimsbf |
| | noise_level | 5 | uimsbf |
| | } | | |
| | else { | | |
| | noise_level=0 | | |
| | } | | |
| optional configuration information | if (!common_window) { | | |
| | ics_info(); | | |
| | } | | |
| optional time warp information | if (tw_mdct) } | | |
| | if (! common_tw) { | | |
| | tw_data(); | | |
| | } | | |
| | } | | |
| | scale_factor_data (); | | |
| optional temporal noise shaping information | tns_data_present; | 1 | uimsbf |
| | if (tns_data_present) { | | |
| | tns_data (); | | |
| | } | | |
| | ac_spectral_data(); | | |
| | } | | |

FIG 3B

Table 4.10-Sytax of ac_spectral_data()

| Syntax | No. of bits | Mnemonic |
|---|---|---|
| ac_spectral_data() | | |
| { | | |
| arith_reset_flag | 1 | uimsbf |
| for (win=0; win<num_windows; win++) { | | |
| arith_data(num_bands, arith_reset_flag) | | |
| } | | |
| } | | |

FIG 4A

FIG 4A

FIG 4B

Sytax of arith_data()

| | Syntax | | No. of bits | Mnemonic |
|---|---|---|---|---|
| | arith_data(lg, arith_reset_flag) | | | |
| | { | | | |
| once per window | if (arith_reset_flag) { | obtain inter-window context information q[0] | | |
| | arith_reset_context(); | | | |
| | } | | | |
| | else { | | | |
| | arith_map_context(lg/4); | | | |
| | } | | | |
| repeated for lg/4 tuples of spectral values a,b,c,d | for (i=0; i<lg/4; i++) { | | | |
| | s=arith_get_context (i); | compute state of context | | |
| | lev=s>>24; | | | |
| | t=s & 0xFFFFFF + 1; | | | |
| | for (j=0;;) { | | | |
| | pki=arith_get_pk(t) | obtain index pki of cumulative frequencies table | | |
| | acod_ng[pki][ng] | arith codeword for encoding group index ng taking into account cumulative frequencies table having index pki | 1..20 | vlclbf |
| | if (ng !=ARITH_ESCAPE) | exception treatment | | |
| | break; | | | |
| | lev +=2; | | | |
| | if (!j) {t+=4194304;} else {t=0} | | | |
| | j=1; | | | |
| | } | | | |
| | j=dgroups[ng]; | | | |
| optional | mm = j & 255; | arithmetic codeword for encoding element index ne | | |
| | if (mm>1) { | | | |
| | acod_ne[ne] | | 1..20 | vlclbf |
| | } | | | |

Definitions of payloads of the "spectral noiseless coder"

| | |
|---|---|
| arith_data() | Data element to decode the spectral noiseless data |
| **arith_reset_flag** | Flag which indicates if the spectral noiseless context must be reset. |
| **acod_ng[pki][ng]** | Arithmetic codeword necessary for arithmetic decoding of the 4-tuple (a,b,c,d) group index *ng*, where a,b,c,d are the quantized spectral coefficients. |
| **arith_ne[ne]** (=acod_ne[ne]) | Arithmetic codeword necessary for arithmetic decoding of the 4-tuple (a,b,c,d) element index *ne*. |
| **arith_r[][][][]** (=acod_r [][][][]) | Arithmetic codeword necessary for arithmetic decoding of the 4-tuple (a,b,c,d) residual bit-planes. |

Help elements

| | |
|---|---|
| a,b,c,d | 4-tuple corresponding to quantized spectral coefficients |
| lg | Number of quantized coefficients to decode. |
| i | Index of 4-tuples. |
| ng | Index of the group to which belongs the 4-tuple a,b,c,d |
| ne | Index of the 4-tuples a,b,c,d within the group ng |
| pki | Index of the cumulative frequencies table used by the arithmetic decoder for decoding ng. |
| arith_get_pk () | Function that returns the index pki of comulative frequencies table necessary to decode the codeword **acod_ng[pki][ng]**. |
| t | State of context |
| arith_get_context () | Function that returns the state of the context. |
| arith_reset_context () | Function that resets the context of the noiseless coder. |
| s | State of the context combined with predicted bit-plane level. |
| lev | Level of bit-planes to decode beyond the most significant 2-bits wise plane. |
| j | Indicate if an ARITH_ESCAPE symbol occurred |
| ARITH_ESCAPE | Escape symbol that indicates additional bit-planes to decode |

FIG 5

Definitions:

| | |
|---|---|
| (a,b,c,d) | 4-tuple decode |
| ng | Group index of the most significant 2-bits-wise plane of the 4-tuple, where 0<=ng<=544. The last value 544 corresponds to the escape symbol, ARITH_ESCAPE |
| ne | Element index within a group. ne lies between 0 and the cardinal of each group mm. The maximum number of element within a group is 73 |
| lev | Level of the remaining bit-planes. It corresponds to number the bit planes less significant than the most significant 2 bits-wise plane. |
| egroups[a][b][c][d] | Group index table. It permits to map the most significant 2 bits-wise plane of the 4-tuple (a,b,c,d) into the 544 groups. |
| mm | Cardinal of the group |
| og | Offset of the group |
| dgroups[] | Maps the group index ng to the cardinal of each group mm(first 8 bits) and the offset of the group og in dgvectors[] (last 8 bits) |
| dgvevtors[] | Map the offset of the group og and the index of the element ne to the most significant 2 bits-wise of the 4-tuple (a,b,c,d). |
| arith_cf_ng_hash[] | Hash table mapping the state of context to a cumulative frequencies table pki |
| arith_cf_ng[pki][545] | Models of the cumulative frequencies for the group index symbol ng |
| arith_cf_ne[] | Cumulative frequencies for element index symbol ne |
| r | Bit plane of the 4-tuple less significant than the most significant 2-bits wise plane. |
| arith_cf_r[] | Cumulative frequencies for the least significant bit-planes symbol r |

FIG 8

FIG 9A

```
*global variables*/
q[2][290] /*current context*/
qs[258]/*past context*/
previous_lg /*number of 4-tuples of the past context*/

arith_reset_context()
{
    for(i=0;i<258;i++){
        qs[i].a=0; qs[i].b=0; qs[i].c=0; qs[i].d=0
        qs[i].v=-1;
    }
    for(i=0;i<290;i++){
        q[0][i].a=0; q[0][i].b=0; q[0][i].c=0; q[0][i].d=0
        q[0][i].v=-1;
        q[1][i].a=0; q[1][i].b=0; q[1][i].c=0; q[1][i].d=0
        q[1][i].v=-1;

    }
    previous_lg=256;
}
```

FIG 9B

```
/*input variable*/
lg/4 /*number of 4-tuples*/

arith_map_context(lg)
{
    v=w=0

    if(core_mode==1){
        q[0][v++]=qs[w++];
    }

    ratio= ((float)previous_lg)/((float)lg);
    for(j=0; j<lg; j++){
        k = (int) ((float)) ((j)*ratio);
        q[0][v++] = qs[w+k];
    }

    if(core_mode==0){
        q[0][lg]=qs[previous_lg];
    }
    q[0][lg+1]=qs[previous_lg+1];

    previous_lg=lg;
}
```

tcx

```
/*input variables*/
i /*the index of the 4-tuple to decode in the vector*/

arith_get_context(i,)
{
        t0=q[0][1+i].v+1;
        t1=q[1][1+i-1].v+1;
        t2=q[0][1+i-1].v+1;
        T3=q[0][1+i+1].v+1;

        if ( (t0<10) && (t1<10) && (t2<10) && (t3<10) ){
                if ( t2>1 ) t2=2;
                if ( t3>1 ) t3=2;
                return 3*(3*(3*(3*(3*(10*(10*t0+t1))+t2)+t3)));
        }
        if ( (t0<34) && (t1<34) && (t2<34) && (t3<34) ){
                if ( (t2>1) && (t2<10) ) t2=2; else if ( t2>=10 ) t2=3;
                if ( (t3>1) && (t3<10) ) t3=2; else if ( t3>=10 ) t3=3;
                return 252000+4*(4*(34*(34*t0+t1))+t2)+t3;
        }

        if ( (t0<90) && (t1<90) ) return 880864+90*(90*t0+t1);

        if ( (t0<544) && (t1<544) ) return 1609864 + 544*t0+t1;

        if ( t0>1 )
        {
                a0=q[0][i].a;
                b0=q[0][i].b;
                c0=q[0][i].c;
                d0=q[0][i].d;
        }
        else a0=b0=c0=d0=0;

        if ( t1>1 )
        {
                a1=q[1][i-1].a;
                b1=q[1][i-1].b;
                c1=q[1][i-1].c;
                d1=q[1][i-1].d;
        }
        else a1=b1=c1=d1=0;

        l=0;
        do
        {
                a0>>=1;
                b0>>=1;
                c0>>=1;
                d0>>=1;

                a1>>=1;
                b1>>=1;
                c1>>=1;
                d1>>=1;

                l++;
        }
        while (  (a0<-4) || (a0>=4) || (b0<-4) || (b0>=4) || (c0<-4) || (c0>=4) || (d0<-4) || (d0>=4) ||
                (a1<-4) || (a1>=4) || (b1<-4) || (b1>=4) || (c1<-4) || (c1>=4) || (d1<-4) || (d1>=4));


        if ( t0>1 ) t0=1+(egroups[4+a0][4+b0][4+c0][4+d0] >> 16);
        if ( t1>1 ) t1=1+(egroups[4+a1][4+b1][4+c1][4+d1] >> 16);

        return 1609864 +  ((l<<24)|(544*t0+t1));
}
```

FIG 9C

```
/*input variable*/
s /* State of the context*/

arith_get_pk(s)
{
        psci[28] = {
                247,248,249,250,251,252,253,254,254,0,254,254,254,255,250,215,
                215,70,70,123,123,123,123,3,67,78,82,152
        };
        register unsigned char *p;
        register unsigned long        i,j;
        i=123*s;
        for (;;)
        {
                j=arith_cf_nq_hash[i&32767];
                if ( j==0xFFFFFFFFul ) break;
                if ( (j>>8)==s ) return j&255;
                i++;
        }
        p=psci+7*(s>>22);
        j= s & 4194303;
        if ( j<436961 )
        {
                if ( j<252001 ) return p[(j<243001)?0:1]; else return p[(j<288993)?2:3];
        }
        else
        {
                if ( j<1609865 ) return p[(j<880865)?4:5]; else return p[6];
        }
}
```

FIG 9D

```
/*helper funtions*/
bool arith_first_symbol(void);
        /* Return TRUE if it is the first symbol of the sequence, FALSE otherwise*/
Ushort arith_get_next_bit(void);
        /* Get the next bit of the bitstream*/

/* global variables */
low
high
value

/* input variables */
cum_freq[];
cfl;

arith_decode()
{
        if(arith_first_symbol())
        {
                value = 0;
                for (i=1; i<=20; i++)
                {
                value = (val<<1) | arith_get_next_bit();
                }
                low=0;
                high=1048575;
        }

        range = high-low+1;
        cum =((((int64) (value-low+1))<<16)-((int64) 1))/((int64) range);
        p = cum_freq-1;

        do
        {
        q=p+(cfl>>1);
        if ( *q > cum ) {p=q; cfl++; }
        cfl>>=1;
        }
        while ( cfl>1 );

        symbol = p-cum_freq+1;
        if(symbol)
                high=low+(((int64) range)*((int64)cum_freq[symbol-1]))>>16 - 1;

        low  += (((int64) range)* ((int64) cum_freq[symbol]))>>16;

        for (;;)
        {
        if ( high<524286) { }
            else if ( low>=524286)
                {
                value -=524286;
                        low -=524286;
                high -=524286;
                }
                else if ( low>=262143 && high<786429)
        {
                value -= 262143;
                low -= 262143;
                high -= 262143;
        }
        else break;

        low += low;
        high += high+1;
                value = (value<<1) | arith_get_next_bit();
        }
        return symbol;
}
```

FIG 9E

```
arith_update_context(a,b,c,d,i,lg)
{
        q[1][1+i].a=a;
        q[1][1+i].b=b;
        q[1][1+i].c=c;
        q[1][1+i].d=d;

        if ( (a<-4) || (a>=4) || (b<-4) || (b>=4) || (c<-4) || (c>=4) || (d<-4) || (d>=4) )
                q[1][1+i].v =1024;
        else q[1][1+i].v=egroups[4+a][4+b][4+c][4+d];

        if(i==lg && core_mode==1) {
                qs[0]=q[1][0];

                ratio= ((float) lg)/((float)256);
                for(j=0; j<256; j++){
                        k = (int) ((float))((j)*ratio);
                        qs[1+k] = q[1][1+j] ;
                }
                qs[previous_lg+1] = q[1][lg+1];
                previous_lg =256;
                }
        if(i==lg && core_mode==0){
                for(j=0; j<258; j++){
                        qs[j] = q[1][k];
                }
                previous_lg = min(1024,lg);
        }
}
```

performed after the decoding of each tuple of spectral values after decoding a new tuple of spectral values: update context describing previously decoded spectral values of the current frame or window performed once per frame or window after decoding all tuples of spectral values of the current frame or window: update context

FIG 9F

Table – Syntax of lpd_channel_stream()

| Syntax | No. of bits | Mnemonic |
|---|---|---|
| lpd_channel_stream() | | |
| { | | |
| acelp_core_mode | 3 | uimsbf |
| lpd_mode | 5 | uimsbf, Note 1 |
| first_tcx_flag=TRUE; | | |
| k = 0; | | |
| if (first_lpd_flag) {last_lpd_mode = 0; } | | Note 2 |
| while (k < 4) { | | |
| optional { if (mod[k] == 0) { | | |
| acelp_coding(acelp_core_mode); | ACELP stimulus encoding | |
| last_lpd_mode=0; | | |
| k += 1; | | |
| } } | | |
| else { | TCX stimulus encoding | |
| tcx_coding( lg(mod[k], last_lpd_mode) , first_tcx_flag); | | Note 3 |
| last_lpd_mode=mod[k]; | | |
| k += ( 1 << (mod[k]-1) ); | | |
| first_tcx_flag=FALSE; | | |
| } | | |
| } | | |
| lpc_data(first_lpd_flag) | | |
| } | | |

Note 1: lpd_mode defines the contents of the array mod[]
Note 2: first_lpd_flag indicates whether the current superframe is the first in a sequence of LPC coded superframes
Note 3: The number of spectral coefficients, lg, depends on mod[k] and last_lpd_mode

FIG 11A

Table – Syntax of tcx_coding()

| | Syntax | | No. of bits | Mnemonic |
|---|---|---|---|---|
| | tcx_coding(lg, first_tcx_flag) | | | |
| | { | | | |
| optional | noise_factor | | 3 | uimsbf |
| | global_gain | | 7 | uimsbf |
| | if (first_tcx_flag ) { | arith_reset_flag encoded for first tcx block of a frame only | | |
| | arith_reset_flag | | 1 | uimsbf |
| | } | | | |
| | else { | no arith reset flag and no reset of context for subsequent tcx blocks frame | | |
| | arith_reset_flag=0 | | | |
| | } | | | |
| | arith_data(lg, arith_reset_flag) | | | |
| | } | | | |

FIG 11B

Definitions, Data Elements acelp_core_mode — This bitfield indicates the exact bit allocation scheme in case ACELP is used as a lpd coding mode.

lpd_mode — The bit-field mode defines the coding modes for each of the four frames within one superframe of the lpd_channel_stream() (corresponds to one AAC frame). The coding modes are stored in the array mod[] and can take values from 0 to 3. The mapping from lpd_mode to mod[] can be determined from the table below.

Table – Mapping of coding modes for lpd_channel_stream()

| | meaning of bits in bit-field mode | | | | | remaining mod[] entries |
|---|---|---|---|---|---|---|
| lpd_mode | bit 4 | bit 3 | bit 2 | bit 1 | bit 0 | |
| 0..15 | 0 | mod[3] | mod[2] | mod[1] | mod[0] | |
| 16..19 | 1 | 0 | 0 | mod[3] | mod[2] | mod[1]=2<br>mod[0]=2 |
| 20..23 | 1 | 0 | 1 | mod[1] | mod[0] | mod[3]=2<br>mod[2]=2 |
| 24 | 1 | 1 | 0 | 0 | 0 | mod[3]=2<br>mod[2]=2<br>mod[1]=2<br>mod[0]=2 |
| 25 | 1 | 1 | 0 | 0 | 1 | mod[3]=3<br>mod[2]=3<br>mod[1]=3<br>mod[0]=3 |
| 26..31 | | | | | | reserved |

mod[0..3] — The values in the array mod[] indicate the respective coding modes in each frame:

Table – Coding modes indicated by mod[]

| value of mod[x] | coding mode in frame | bitstream element |
|---|---|---|
| 0 | ACELP | acelp_coding() |
| 1 | one frame of TCX | tcx_coding() |
| 2 | TCX covering half a superframe | tcx_coding() |
| 3 | TCX covering entire superframe | tcx_coding() |

acelp_coding() — Syntax element which contains all data to decode one frameof ACELP excitation.

tcx_coding() — Syntax element which contains all data to decode one frame of MDCT based transform coded excitation (TCX).

FIG 11C

Definitions, Data Elements (continued)

first_tcx_flag — Flag which indicates if the current processed TCX frame is the first in the superframe.

arith_reset_flag — see: the definition in FIG 5 lpc_data() — Syntax element which contains all data to decode all LPC filter parameter sets required to decode the current superframe.

first_lpd_flag — Flag which indicates whether the current superframe is the first of a sequence of superframes which are coded in LPC domain. This flag can also be determined from the history of the bitstream element core_mode (core_mode0 and core_mode1 in case of a channel_pair_element) according to the following table.

Table – Definition of first_lpd_flag

| core_mode of previous frame (superframe) | core_mode of current frame (superframe) | first_lpt_flag |
|---|---|---|
| 0 | 1 | 1 |
| 1 | 1 | 0 |

last_lpd_mode — Indicates the lpd_mode of the previously decoded frame.

nb_lpc — Overall number of LPC parameters sets which are encoded in the bit stream.

mode_lpc — Coding mode of the subsequent LPC parameters.

lpc[k][x] — LPC parameter number x of set k.

FIG 11D

AUDIO DECODER, AUDIO ENCODER, METHOD FOR DECODING AN AUDIO SIGNAL, METHOD FOR ENCODING AN AUDIO SIGNAL, COMPUTER PROGRAM AND AUDIO SIGNAL

CROSS-REFERENCE TO RELATED APPLICATIONS

This application is a continuation of International Patent Application No. PCT/EP2009/007169 filed Oct. 6, 2009, which claims priority to U.S. Patent Application Ser. No. 61/103,820, filed Oct. 8, 2008, which is incorporated herein by reference in its entirety.

BACKGROUND OF THE INVENTION

Embodiments according to the invention are related to an audio decoder, an audio encoder, a method for decoding an audio signal, a method for encoding an audio signal and a corresponding computer program. Some embodiments are related to an audio signal.

Some embodiments according to the invention are related to an audio encoding/decoding concept, in which a side information is used for resetting a context of an entropy encoding/decoding.

Some embodiments are related to the control of the reset of an arithmetic coder.

Traditional audio coding concepts include an entropy coding scheme (for example for encoding spectral coefficients of a frequency domain signal representation) in order to reduce redundancy. Typically, entropy coding is applied to quantized spectral coefficients for frequency domain based coding schemes or quantized time domain samples for time domain based coding schemes. These entropy coding schemes typically make use of transmitting a code word in combination with an according code book index, which enables a decoder to look up a certain code book page for decoding an encoded information word corresponding to the transmitted code word on said code book page.

For details regarding such an audio coding concept, reference is made, for example, to international standard ISO/IEC 14496-3:2005(E), part 3: audio, part 4: general audio coding (GA)-AAC, Twin VQ, BSAC, in which the so called concept for "entropy/coding" is described.

However, it has been found that a significant overhead in bitrate is produced by the need for a regular transmission of a detailed code book selection information (e.g. sect_cb).

SUMMARY

According to an embodiment, an audio decoder for providing a decoded audio information on the basis of an entropy encoded audio information may have: a context-based entropy decoder configured to decode the entropy-encoded audio information in dependence on a context, which context is based on a previously-decoded audio information in a non-reset state-of-operation; wherein the context-based entropy decoder is configured to select a mapping information, for deriving the decoded audio information from the encoded audio information, in dependence on the context; and wherein the context-based entropy decoder includes a context resetter configured to reset the context for selecting the mapping information to a default context, which default context is independent from the previously-decoded audio information, in response to a side information of the encoded audio information.

According to another embodiment, a method for providing a decoded audio information on the basis of an encoded audio information may have the steps of: decoding the entropy-encoded audio information taking into account a context, which is based on a previously-decoded audio information in a non-reset state of operation, wherein decoding the entropy-encoded audio information includes selecting a mapping information for deriving the decoded audio information from the encoded audio information, in dependence on the context, and using the selected mapping information for deriving a first portion of the decoded audio information; and wherein decoding the entropy-encoded audio information also includes resetting the context for selecting the mapping information to a default context, which is independent from the previously-decoded audio information, in response to a side information, and using the mapping information, which is based on the default context, for decoding a second portion of the decoded audio information.

According to another embodiment, an audio encoder for providing an encoded audio information on the basis of an input audio information may have: a context-based entropy encoder configured to encode a given audio information of the input audio information in dependence on a context, which context is based on an adjacent audio information, temporally or spectrally adjacent to the given audio information, in a non-reset state of operation; wherein the context-based entropy encoder is configured to select a mapping information for deriving the encoded audio information from the input audio information, in dependence on the context; and wherein the context-based entropy encoder includes a context resetter configured to reset the context for selecting the mapping information to a default context within a contiguous piece of input audio information, in response to the occurrence of a context reset condition; and wherein the audio encoder is configured to provide a side information of the encoded audio information indicating the presence of a context reset condition.

According to another embodiment, a method for providing an encoded audio information on the basis of an input audio information may have the steps of: encoding a given audio information of the input audio information in dependence on a context, which context is based on an adjacent audio information, temporally or spectrally adjacent to the given audio information, in a non-reset state of operation, wherein encoding the given audio information in dependence on the context includes selecting a mapping information, for deriving the encoded audio information from the input audio information, in dependence on the context, resetting the context for selecting the mapping information to a default context within a contiguous piece of input audio information in response to the occurrence of a context reset condition; and providing a side information of the encoded audio information indicating the presence of the context reset condition.

Another embodiment may have a computer program for performing the method for providing a decoded audio information on the basis of an encoded audio information, which method may have the steps of: decoding the entropy-encoded audio information taking into account a context, which is based on a previously-decoded audio information in a non-reset state of operation, wherein decoding the entropy-encoded audio information includes selecting a mapping information for deriving the decoded audio information from the encoded audio information, in dependence on the context, and using the selected mapping information for deriving a first portion of the decoded audio information; and wherein decoding the entropy-encoded audio information also includes resetting the context for selecting the mapping information to a default context, which is independent from the previously-decoded audio information, in response to a side information, and using the mapping information, which is based on the default context, for decoding a second portion of the decoded audio information, when the computer program runs on a computer.

Another embodiment may have a computer program for performing the method for providing an encoded audio information on the basis of an input audio information, which method may have the steps of: encoding a given audio information of the input audio information in dependence on a context, which context is based on an adjacent audio information, temporally or spectrally adjacent to the given audio information, in a non-reset state of operation, wherein encoding the given audio information in dependence on the context includes selecting a mapping information, for deriving the encoded audio information from the input audio information, in dependence on the context, resetting the context for selecting the mapping information to a default context within a contiguous piece of input audio information in response to the occurrence of a context reset condition; and providing a side information of the encoded audio information indicating the presence of the context reset condition, when the computer program runs on a computer.

According to another embodiment, an encoded audio signal may have: an encoded representation of a plurality of sets of spectral values, wherein a plurality of the sets of spectral values are encoded in dependence on an non-reset context, which is dependent on a respective preceding set of spectral values; wherein a plurality of the sets of spectral values are encoded in dependence on a default context, which is independent from a respective preceding set of spectral values; and wherein the encoded audio signal includes a side information signaling if a set of spectral coefficients is encoded in dependence on a non-reset context or in dependence on the default context.

An embodiment according to the invention creates an audio decoder for providing a decoded audio information on the basis of an encoded audio information. The audio decoder comprises a context-based entropy decoder configured to decode the entropy-encoded audio information in dependence on a context, which context is based on a previously decoded audio information in a non-reset state of operation. The entropy decoder is configured to select a mapping information (e.g. a cumulative frequencies table, or a Huffmann-codebook) for deriving the decoded audio information from the encoded audio information in dependence on the context. In addition, the context-based entropy decoder also comprises a context resetter configured to reset the context for selecting the mapping information to a default context, which is independent from the previously decoded audio information, in response to a side information of the encoded audio information.

This embodiment is based on finding that in many cases it is bitrate-efficient to derive the context, which determines the mapping of an entropy-encoded audio information onto a decoded audio information (for example by examining a code book, or by determining a probability distribution) in dependence on a context which is based on previously decoded audio information items, as accordingly, correlations within the entropy-encoded audio information can be exploited. For example, if a certain spectral bin comprises a large intensity in the first audio frame, then there is a high probability that the same spectral bin again comprises a large intensity in the next audio frame following the first audio frame. Thus, it becomes apparent that a selection of the mapping information on the basis of the context allows for a reduction of the bitrate when compared to a case in which a detailed information for the selection of a mapping information for deriving the decoded audio information from the encoded audio information is transmitted.

However, it has also been found that a derivation of the context from the previously decoded audio information sometimes results in situations in which a mapping information (for deriving the decoded audio information from the encoded audio information) is chosen, which is significantly inappropriate and thus results in an unnecessarily high bit demand for encoding the audio information. This situation would occur, if for example, the spectral energy distribution of subsequent audio frames differ significantly, such that new spectral energy distribution within the subsequent audio frame deviates strongly from the distribution which would be expected on the basis of a knowledge of the spectral distribution within the previous audio frame.

According to a key idea of the invention, in such cases, in which the bitrate would be significantly degraded by the choice of an inappropriate mapping information (for deriving the decoded audio information from the encoded audio information), the context is reset in response to a side information of the encoded audio information, thereby achieving the selection of a default mapping information (being associated with the default context) which in turn results in a moderate bit consumption for an encoding/decoding of the audio information.

To summarize the above, it is the key idea of the present invention that a bitrate-efficient encoding of an audio information can be achieved by combining a context-based entropy decoder, which normally (in a non-reset state of operation) uses a previously encoded audio information for deriving a context and for selecting a corresponding mapping information, with a side-information-based reset mechanism for resetting the context, because such a concept brings along a minimum effort for maintaining an appropriate decoding context, which is well-adapted to the audio content in a normal case (when the audio content fulfills the expectations used for the design of the context-based selection of a mapping rule) and avoids an excessive increase of the bitrate in an abnormal case (when the audio content strongly deviates from said expectations).

In an advantageous embodiment, the context resetter is configured to selectively reset the context-based entropy decoder at a transition between subsequent time portions (e.g. audio frames) having associated spectral data of the same spectral resolution (e.g. number of frequency bins). This embodiment is based on the finding that a reset of the context may have advantageous effect (in terms of reducing the useful bitrate) even if the spectral resolution remains unchanged. In other words, it has been found that it should be possible to perform a reset of the context independent from a change of the spectral resolution, because it has been found that the context may be inappropriate even if it is not necessary to change the spectral resolution (for example, by switching from a "long window" per frame to a plurality of "short windows" per frame). In other words, it has been found that a context may be inappropriate (which raises the desire to reset the context) even in a situation in which it is not desirable to change from a low temporal resolution (e.g. long window, in combination with high spectral resolution) to a high temporal resolution (e.g. short windows, in combination with a small spectral resolution).

In an advantageous embodiment, the audio decoder is configured to receive, as the encoded audio information, an information describing spectral values in a first audio frame and in a second audio frame subsequent to the first audio frame. In this case, the audio decoder advantageously comprises a spectral-domain-to-time-domain transformer configured to overlap-and-add a first windowed time domain signal, which is based on the spectral values of the first audio frame, and a second windowed time domain signal, which is based on the spectral values of the second audio frame. The audio decoder is configured to separately adjust a window shape of a window for obtaining the first windowed time domain signal and of a window for obtaining the second windowed time domain signal. The audio decoder is also advantageously configured to perform, in response to the side information, a reset of the context between a decoding of the spectral values of the first audio frame and a decoding of the spectral values of the second audio frame, even if the second window shape is identical to the first window shape, such that the context used for decoding the encoded audio information of the second audio frame is independent of the decoded audio information of the first audio frame in the case of a reset.

This embodiment allows for a reset of the context between a decoding (using mapping information selected on the basis of the context) of spectral values of the first audio frame and a decoding (using mapping information selected on the basis of the context) of spectral values of the second audio frame, even if windowed time domain signals of the first and second audio frames are overlapped-and-added, and even if identical window shapes are selected for deriving the first windowed time domain signal and the second windowed time domain signal from the spectral values of the first audio frame and the second audio frame.

Thus, the reset of the context may be introduced as an additional degree of freedom, which can be applied by the context resetter even between a decoding of spectral values of closely-related audio frames, the windowed time domain signals of which are derived using identical window shapes and are overlapped-and-added.

Thus, it is advantageous that the reset of context is independent from used window shapes and also independent from the fact that windowed time domain signals of subsequent frames belong to a contiguous audio content, i.e. are overlapped-and-added.

In an advantageous embodiment, the entropy decoder is configured to reset, in response to side information, the context between the decoding of audio information of adjacent frames of the audio information having identical frequency resolutions. In this embodiment, a reset of the context is performed independent from a change of the frequency resolution.

In yet another advantageous embodiment, the audio decoder is configured to receive a context-reset side information for signaling a reset of the context. In this case, the audio decoder is also configured to additionally receive a window-shape side information to adjust the window shapes of windows for obtaining the first and second windowed time signals independent from performing the reset of the context.

In an advantageous embodiment, the audio decoder is configured to receive, as the side information for resetting the context, a one-bit context reset flag per audio frame of the encoded audio information. In this case, the audio decoder is advantageously configured to receive, in addition to the context reset flag, a side information describing a spectral resolution of spectral values represented by the encoded audio information or a window length of a time window, for windowing time domain values represented by the encoded audio information. The context resetter is configured to perform a reset of the context in response to the one-bit context-reset-flag at a transition between two audio frames of the encoded audio information representing spectral values of identical spectral resolutions. In this case, the one-bit context reset-flag typically results in a single reset of the context between a decoding of encoded audio information of subsequent audio frames.

In another advantageous embodiment, the audio decoder is configured to receive, as a side information for resetting the context, a one-bit context to reset-flag per audio frame of the encoded audio information. Also, the audio decoder is configured to receive an encoded audio information comprising of a plurality of sets of spectral values per audio frame (such that a single audio frame is subdivided into multiple sub frames, to which individual short windows may be associated). In this case, the context-based entropy decoder is configured to decode the entropy-decoded audio information of a subsequent set of spectral values of a given audio frame in dependence on a context, which context is based on a previously decoded audio information of a preceding set of spectral values of the given audio frame in a non-reset state of operation. However, the context resetter is configured to reset the context to the default context before a decoding of a first set of spectral values of the given audio frame and between a decoding of any two subsequent sets of spectral values of the given audio frame in response to the one-bit context reset flag (i.e. if, and only if, the one-bit context reset flag is active), such that an activation of the one-bit context reset flag of the given audio frame causes a multiple-times resetting of the context when decoding the multiple sets of spectral values of the audio frame.

This embodiment is based on the finding that in this typically inefficient, in terms of bitrate, to perform only a single reset of the context in an audio frame comprising a plurality of "short windows," for which individual sets of spectral values are encoded. Rather an audio frame comprising multiple sets of spectral values typically comprises a strong discontinuity of the audio content, such that it is advisable, in order to reduce the bitrate, to reset the context between each of the subsequent sets of spectral values. Such a solution has been found to be more efficient than a one-time reset of the context (for example, only at the beginning of the frame) and than individually signaling (e.g. using extra one-bit flags) multiple context reset times within the (multiple-short-window) frame.

In an advantageous embodiment, the audio decoder is configured to also receive a grouping side information when using so-called "short windows" (i.e. transmitting multiple sets of spectral values, which are overlapped-and-added using multiple short windows being shorter than an audio frame). In this case, the audio decoder is advantageously configured to group two or more of the sets of spectral values for a combination with a common scale factor information in dependence on the grouping side information. In this case, the context-resetter is advantageously configured to reset the context to the default context between a decoding of sets of spectral values grouped together in response to the one-bit context reset flag. This embodiment is based on the finding that, in some cases, there may be a strong variation of the decoded audio values (e.g. decoded spectral values) of a grouped sequence of sets of spectral values, even if the initial scale factors are applicable to the subsequent sets of spectral values. For example, if there is a steady yet significant frequency variation between subsequent sets of spectral values, the scale factors of the subsequent sets of spectral values may be equal (for example, if the frequency variation does not exceed a scale factor band), while it is nevertheless appropriate to reset the context at the transition between the different sets of spectral values. Thus, the described embodiment allows for a bitrate efficient encoding and decoding even in the presence of such frequency-variation audio signal transitions. Also, this concept still allows for good performance when encoding rapid volume changes in the presence of strongly correlated spectral values. In this case, a reset of the context can be avoided by deactivating the context-reset-flag, even though different scale factors may be associated with subsequent set of spectral values (which are not grouped together in this case, because the scale factors differ).

In another embodiment, the audio decoder is configured to receive, as the side information for resetting the context, a one-bit context reset flag per audio frame of the encoded audio information. In this case, the audio decoder is also configured to receive, as the encoded audio information, a sequence of encoded audio frames, the sequence of encoded frames comprising a linear-prediction-domain audio frame. The linear-prediction-domain audio frame comprises, for example, a selectable number of transform-coded-excitation portions for exciting a linear-prediction-domain audio synthesizer. The context-based entropy decoder is configured to decode spectral values of the transform-coded-excitation portions in dependence on a context, which context is based on a previously-decoded audio information in a non-reset state of operation. The context resetter is configured to reset, in response to the side information, the context to the default context before a decoding of a set of spectral values of a first transform-coded-excitation portion of a given audio frame, while omitting a reset of the context to the default context between a decoding of sets of spectral values of different transform-coded-excitation portions of (i.e. within) the given audio frame. This embodiment is based on the finding that a combination of a context-based decoding and a context reset brings along a reduction of the bitrate when encoding a transform-coded-excitation for a linear-prediction-domain audio synthesizer. In addition, it has been found that a temporal granularity for resetting the context when encoding a transform-coded-excitation typically can be chosen larger than a temporal granularity of resetting the context in the presence of a transition (short windows) of a pure frequency domain encoding (e.g. an Advanced-Audio-Coding-type audio coding).

In another advantageous embodiment, the audio decoder is configured to receive an encoded audio information comprising a plurality of sets of spectral values per audio frame. In this case, the audio decoder is also advantageously configured to receive a grouping side information. The audio decoder is configured to group two or more of the sets of spectral values for a combination with a common scale factor information in dependence on the grouping side information. In the advantageous embodiment, the context resetter is configured to reset the context to the default context in response to (i.e. in dependence on) the grouping side information. The context resetter is configured to reset the context between a decoding of sets of spectral values of subsequent groups, and to avoid to reset the context between a decoding of sets of spectral values of a single group (i.e. within a group). This embodiment of the invention is based on the finding that it is not necessary to use a dedicated context reset side information if there is a signaling of sets of spatial values having high similarity (and being grouped together for this reason). In particular, it has been found that there are many cases in which it is appropriate to reset the context whenever the scale factor data change (for example at a transition from one set of spectral values to another set of spectral values within a window, particularly if the sets of spectral values are not grouped, or at a transition from one window to another window). If however, it is desired to reset the context between two sets of spectral values, to which the same scale factors are associated, it is still possible to enforce the reset by signaling the presence of a new group. This brings along the price of retransmitting identical scale factors, but might be advantageous if a missing reset of the context would significantly degrade the coding efficiency. Nevertheless, an evaluation of the grouping side information for the reset of the context may be an efficient concept to avoid the need to transmit a dedicated context reset side information while still allowing a reset of the context whenever appropriate. In those cases in which the context may (or should) be reset even when the same scale factor information could be used, there is a penalty in terms of bitrate (caused by the need to use an additional group and retransmit the scale factor information), which penalty in bitrate may be compensated by a bitrate reduction in other frames.

Another embodiment according to the invention creates an audio encoder for providing an encoded audio information on the basis of an input audio information. The audio encoder comprises a context-based entropy encoder configured to encode a given audio information of the input audio information in dependence on a context, which context is based on an adjacent audio information, temporarily or spatially adjacent to the given audio information, in a non-reset state of operation. The context-based entropy encoder is also configured to select a mapping information, for deriving the encoded audio information from the input audio information, in dependence on the context. The context-based entropy encoder also comprises a context resetter configured to reset the context for selecting the mapping information to a default context, which is independent from the previously decoded audio information, within a continuous piece of input audio information in response to the occurrence of a context reset condition. The context-based entropy encoder is also configured to provide a side information of the encoded audio information indicating the presence of a context reset conditional. This embodiment according to the invention is based on the finding that the combination of a context-based entropy encoding and on occasional reset of the context, which is signaled by an appropriate side information, allows for a bitrate-efficient encoding of an input audio information.

In an advantageous embodiment, the audio encoder is configured to perform a regular context reset at least once per n frames of the input audio information. It has been found that a regular context reset brings along the chance to synchronize to an audio signal very rapidly, because a reset of the context introduces a temporal limitation of inter-frame dependencies (or at least contributes to such a limitation of the inter-frame dependences).

In another advantageous embodiment, the audio encoder is configured to switch between a plurality of different coding modes (for example, frequency domain encoding mode and linear-prediction-domain encoding mode). In this case, the audio encoder may advantageously be configured to perform a context reset in response to a change between two coding modes. This embodiment is based on the finding that the change between two coding modes is typically connected with a significant change of the input audio signal, such that there is typically only a very limited correlation between the audio content before the switching of the coding mode and after the switching the coding mode.

In another advantageous embodiment, the audio encoder is configured to compute or estimate a first number of bits that may be used for encoding a certain audio information (e.g. a specific frame or portion of the input audio information, or at least one or more specific spectral values of the input audio information) of the input audio information in dependence on a non-reset context, which non-reset context is based on an adjacent audio information temporarily or spectrally adjacent to the certain audio information, and compute or estimate a second number of bits that may be used for encoding the certain audio information using the default context (e.g. the state of the context to which the context is reset). The audio encoder is further configured to compare the first number of bits and the second number of bits to decide whether to provide the encoded audio information corresponding to the certain audio information on the basis of the non-reset context or on the basis of the default context. The audio encoder is also configured to signal the result of said decision using the side information. This embodiment is based on the finding that it is sometimes difficult to decide a priori whether it is advantageous, in terms of bitrate, to reset the context. A reset of the context may result in a selection of a mapping information (for deriving the encoded audio information from a certain input audio information), which is better suited (in terms of providing a lower bitrate) for the encoding of the certain audio information or worse-suited (in terms of providing a higher bitrate) for encoding the certain audio information. In some cases, it has been found to be advantageous to decide, whether or not to reset the context, by determining the number of bits that may be used for the encoding using both variants, with and without resetting the context.

Further embodiments according to the invention create a method for providing a decoded audio information on the basis of an encoded audio information, and a method for providing an encoded audio information on the basis of an input audio information.

Further embodiments according to the invention create corresponding computer programs.

Further embodiments according to the invention create an audio signal.

BRIEF DESCRIPTION OF THE DRAWINGS

Embodiments of the present invention will be detailed subsequently referring to the appended drawings, in which:

FIG. 3*a* shows a graphical representation, in the form of a syntax representation, of information comprised by a frequency domain channel stream, which can be provided by the inventive audio encoder and which can be used by the inventive audio decoder;

FIG. 3*b* shows a graphical representation, in the form of a syntax representation, of information representing arithmetically coded spectral data of the frequency domain channel stream of FIG. 3*a;*

FIG. 5 shows a legend defining information items and help elements used in the syntax representations of FIGS. 3*a*, 3*b* and 4;

FIG. 8 shows a legend of data items and help elements used for arithmetically decoding an arithmetically encoded spectral information, for example using the algorithm of FIGS. 9*a* to 9*f;*

FIG. 9*a* shows a pseudo program code—in a C-language like form—of a method for resetting a context of an arithmetic coding;

FIG. 9*b* shows a pseudo program code of a method for mapping a context of an arithmetic decoding between frames or windows of identical spectral resolution and also between frames or windows of different spectral resolution;

FIG. 9*c* shows a pseudo program code of a method for deriving a state value from a context;

FIG. 9*d* shows a pseudo program code of a method for deriving an index of a cumulative frequencies table from a value describing the state of the context;

FIG. 9*e* shows a pseudo program code of a method for arithmetically decoding arithmetically encoded spectral values;

FIG. 9*f* shows a pseudo program code of a method for updating the context subsequent to a decoding of a tuple of spectral values;

FIG. 11*a* shows a graphical representation, in the form of a syntax representation, of information comprised by a linear prediction-domain channel stream;

FIG. 11*b* shows a graphical representation, in the form of a syntax representation, of information comprised by a transform coded-excitation coding, which transform-coded-excitation coding is part of the linear-prediction-domain channel stream of FIG. 11*a;*

FIGS. 11*c* and 11*d* show a legend defining information items and help elements used in the syntax representations of FIGS. 11*a* and 11*b;*

DETAILED DESCRIPTION OF THE INVENTION

1. Audio Decoder 1.1 Audio Decoder—Generic Embodiment

Figure 1:
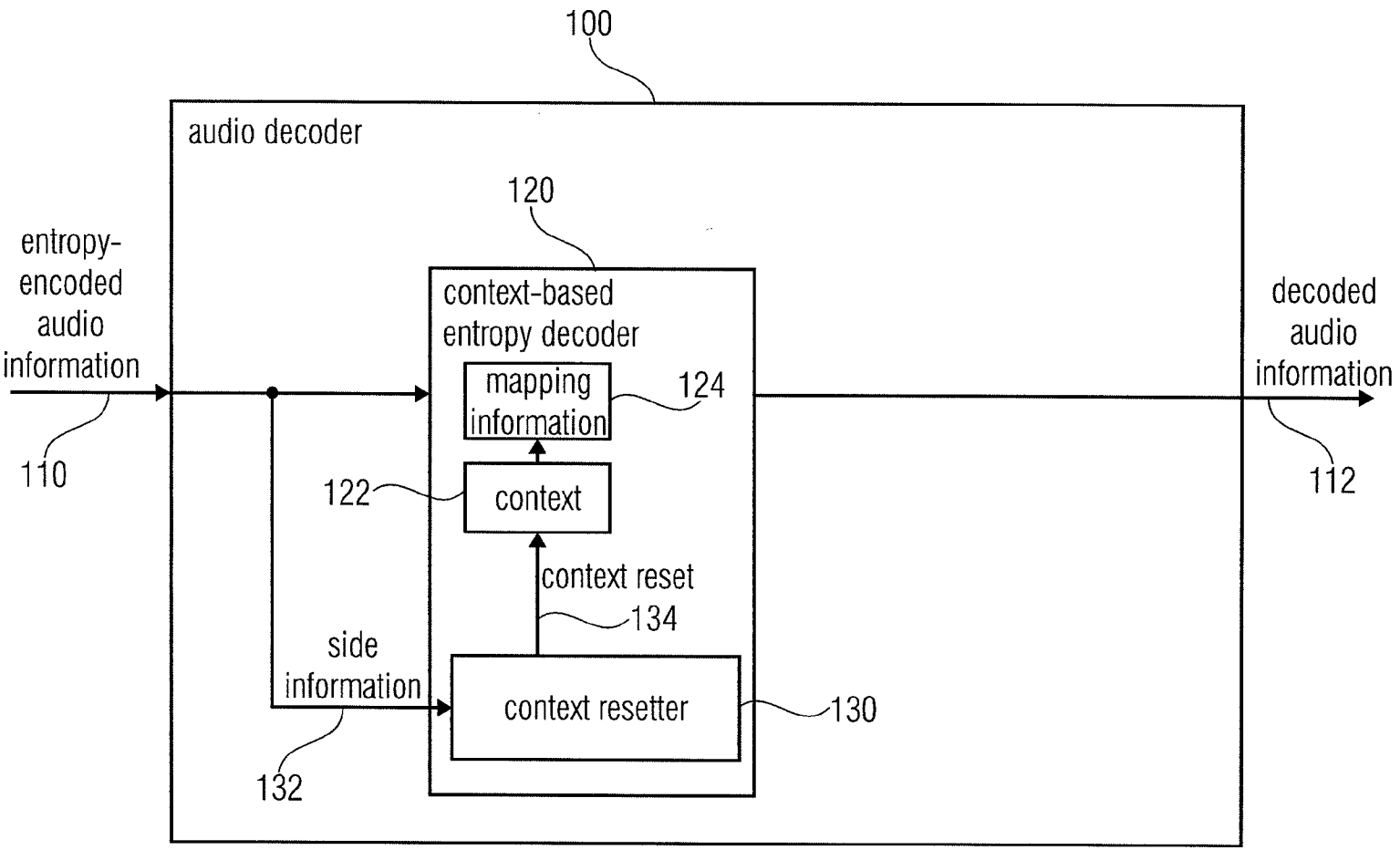
FIG. 1 shows a block schematic diagram of an audio decoder, according to an embodiment of the invention.

FIG. 1 shows a block schematic diagram of an audio decoder, according to an embodiment of the invention. The audio decoder 100 of FIG. 1 is configured to receive an entropy-encoded audio information 110 and to provide, on the basis thereof, a decoded audio information 112. The audio decoder 100 comprises a context-based entropy decoder 120, which is configured to decode the entropy-encoded audio information 110 in dependence on a context 122, which context 122 is based on a previously decoded audio information in a non-reset state of operation. The entropy decoder 120 is also configured to select a mapping information 124, for deriving the decoded audio information 112 from the encoded audio information 110, in dependence on the context 122. The context-based entropy decoder 120 also comprises a context resetter 130, which is configured to receive a side information 132 of the entropy-encoded audio information 110 and to provide a context reset signal 134 on the basis thereof. The context resetter 130 is configured to reset the context 122 for selecting the mapping information 124 to a default context, which is independent from the previously decoded audio information, in response to a respective side information 132 of the entropy-encoded audio information 110.

Thus, in operation, the context resetter 130 resets the context 122 whenever it detects a context-reset side information (e.g. a context reset flag) associated with the entropy-encoded audio information 110. A reset of the context 122 to the default context may have the consequence that a default mapping information (e.g. a default Huffmann-codebook, in the case of a Huffmann coding, or a default (cumulative) frequency information "cum_freq" in the case of an arithmetic coding) is selected for deriving the decoded audio information 112 (e.g. decoded spectral values a,b,c,d) from the entropy-encoded audio information 110 (comprising, e.g. encoded spectral values a,b,c,d).

Accordingly, in a non-reset state of operation, the context 122 is affected by previously decoded audio information, for example spectral values of previously decoded audio frames. Consequently, the selection of the mapping information (which is performed on the basis of the context), for decoding a current audio frame (or for decoding one or more spectral values of the current audio frame), is typically dependent on decoded audio information of a previously decoded frame (or a previously decoded "window").

In contrast, if the context is reset (i.e. in a context reset state of operation), the impact of the previously decoded audio information (e.g. decoded spectral values) of a previously decoded audio frame onto the selection of the mapping information, for decoding a current audio frame, is eliminated. Thus, after a reset, the entropy decoding of the current audio frame (or at least of some spectral values) is typically no longer dependent on the audio information (e.g. spectral values) of the previously decoded audio frame. Nevertheless, a decoding of an audio content (e.g. one or more spectral values) of the current audio frame may (or may not) comprise some dependencies on previously decoded audio information of the same audio frame.

Accordingly, the consideration of the context 122 may improve the mapping information 124 used for deriving the decoded audio information 112 from the encoded audio information 110 in the absence of a reset condition. The context 122 may be reset if the side information 132 indicates a reset condition in order to avoid the consideration of an inappropriate context, which would typically result in an increased bitrate. Accordingly, the audio decoder 100 allows for a decoding of an entropy-encoded audio information with a good bitrate efficiency.

1.2 Audio Decoder-Unified-Speech-and-Audio-Coding (USAC) Embodiment 1.2.1 Decoder Overview In the following, an overview will be given over an audio decoder, which allows for a decoding of both frequency-domain encoded audio content and linear-prediction-domain encoded audio content, thereby allowing for the dynamic (e.g. frame-wise) choice of the most appropriate coding mode. It should be noted that the audio decoder discussed in the following combines frequency-domain decoding and linear-prediction-domain decoding. However, it should be noted that the functionalities that are discussed in the following can be used separately in a frequency-domain audio decoder and a linear-prediction-domain audio decoder.

Figure 2:
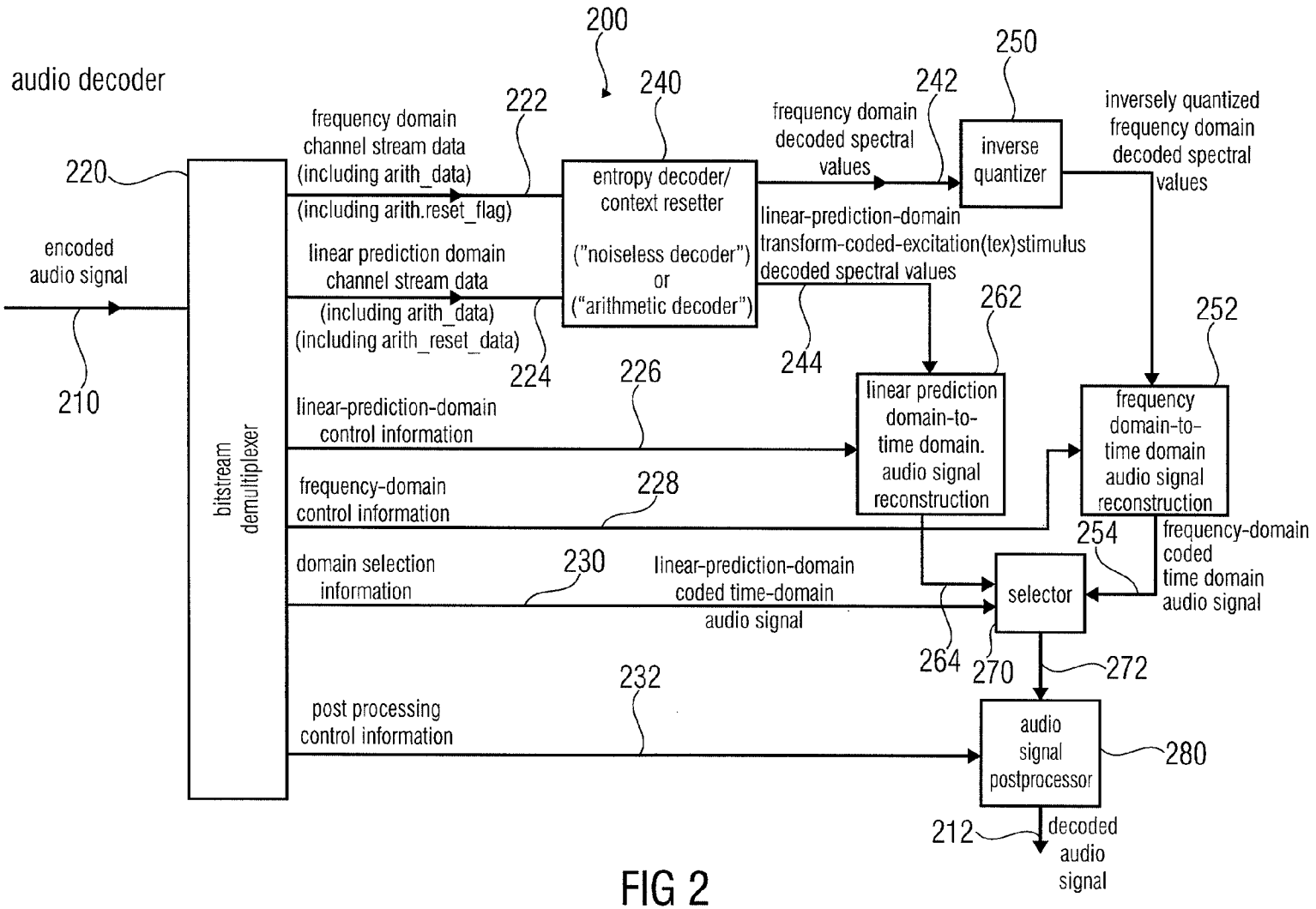
FIG. 2 shows a block schematic diagram of an audio decoder, according to another embodiment of the invention.

FIG. 2 shows an audio decoder 200, which is configured to receive an encoded audio signal 210 and to provide, on the basis thereof, a decoded audio signal 212. The audio decoder 200 is configured to receive a bitstream representing the encoded audio signal 210. The audio decoder 200 comprises a bitstream demultiplexer 220, which is configured to extract different information items from the bitstream representing the encoded audio signal 210. For example, a bitstream multiplexer 220 is configured to extract frequency-domain channel stream data 222, including, for example, so-called "arith_data" and a so-called "arith_reset_flag", and linear-prediction-domain channel stream data 224 (including, for example, so-called "arith_data" and a so-called "arith_reset_flag") from the bit stream representing the encoded audio signal 200, whichever is present within the bitstream. Also, the bitstream demultiplexer is configured to extract additional audio information and/or side information from the bitstream representing the encoded audio signal 200, for example, linear-prediction-domain control information 226, frequency-domain control information 228, domain-selection information 230 and post processing control information 232. The audio decoder 200 also comprises an entropy decoder/context resetter 240, which is configured to entropy-decode entropy-encoded frequency-domain spectral values or entropy-encoded linear-prediction-domain transform-coded-excitation stimulus spectral values. The entropy decoder/context resetter 240 is sometimes also designated as "a noiseless decoder" or "arithmetic decoder," because it typically performs a lossless decoding. The entropy decoder/context resetter 240 is configured to provide frequency-domain decoded spectral values 242 on the basis of the frequency-domain channel stream data 222, or linear-prediction-domain transform-coded-excitation (TCX) stimulus spectral values 244 on the basis of the linear-prediction-domain channel stream data 224. Thus, the entropy decoder/context resetter 240 may be configured to be used both for the decoding of the frequency-domain spectral values and the linear-prediction-domain transform-coded-excitation stimulus spectral values, whichever is present in the bitstream for the current frame.

The audio decoder 200 also comprises a time domain signal reconstruction. In the case of a frequency-domain encoding, the time domain signal reconstruction may for example, comprise an inverse quantizer 250, which receives the frequency-domain decoded spectral values provided by the entropy decoder 240 and to provide, on the basis thereof, inversely quantized frequency-domain decoded spectral values to a frequency-domain-to-time-domain audio signal reconstruction 252. The frequency-domain-to-time-domain audio signal reconstruction may be configured to receive the frequency-domain control information 228 and, optionally, additional information (like, for example, control information). The frequency-domain-to-time-domain audio signal reconstruction 252 may be configured to provide, as an output signal, a frequency-domain coded time domain audio signal 254. Regarding the linear prediction domain, the audio decoder 200 comprises a linear-prediction-domain-to-time-domain audio signal reconstruction 262, which is configured to receive the linear-prediction-domain transform-coded-excitation stimulus decoded spectral values 244, the linear-prediction-domain control information 226 and optionally, additional linear-prediction-domain information (for example coefficients of the linear prediction models, or an encoded version thereof), and to provide, on the basis thereof, a linear-prediction-domain coded time domain audio signal 264.

The audio decoder 200 also comprises a selector 270 for selecting between the frequency-domain coded time domain audio signal 254 and the linear-prediction-domain coded time domain audio signal 264 in dependence on the domain selection information 230, to decide whether the decoded audio signal 212 (or a temporal portion thereof) is based on the frequency-domain coded time domain audio signal 254 or the linear-prediction-domain coded time domain audio signal 264. At the transition between the domains, a cross fade may be performed by the selector 270 to provide the selector output signal 272. The decoded audio signal 212 may be equal to the selector audio signal 272, or may advantageously be derived from the selector signal 272 using an audio signal postprocessor 280. The audio signal postprocessor 280 may take into consideration the post processing control information 232 provided by the bitstream demultiplexer 220.

To summarize the above, the audio decoder 200 may provide the decoded audio signal 212 on the basis of either the frequency-domain channel stream data 222 (in combination with possible additional control information), or the linear-prediction-domain channel stream data 224 (in combination with additional control information), wherein the audio decoder 200 may switch between the frequency-domain and the linear-prediction-domain using the selector 270. The frequency-domain coded time domain audio signal 254 and the linear-prediction-domain coded time domain audio signal 264 may be generated independently from each other. However, the same entropy decoder/context resetter 240 may be applied (possibly in combination with different, domain-specific mapping information, like cumulative frequencies tables) for the derivation of the frequency domain decoded spectral values 242, which form the basis of the frequency-domain coded time domain audio signal 254, and for the derivation of the linear-prediction-domain transform-coded-excitation stimulus decoded spectral values 244, which form the basis for the linear-prediction-domain coded time-domain audio signal 264.

In the following, details regarding the provision of the frequency-domain decoded spectral values 242 and regarding the provision of the linear-prediction-domain transform-coded-excitation stimulus decoded spectral values 244 will be discussed.

It should be noted that details regarding the derivation of the frequency-domain coded time domain audio signal 254 from frequency-domain decoded spectral values 242 can be found in international standard ISO/IEC 14496-3:2005, part 3: audio, part 4: general audio coding (GA)—AC, Twin VQ, BSAC, and the documents referenced therein.

It should also be noted that details regarding the computation of the linear-prediction-domain coded time-domain audio signal 264 on the basis of the linear-prediction-domain transform-coded-excitation stimulus decoded spectral values 244 may for example, be found in the international standards 3GPP TS 26.090, 3GPP TS 26.190 and 3GPP TS 26.290.

Said standards also comprise information regarding some of the symbols used in the following.

1.2.2 Frequency-Domain Channel Stream Decoding

In the following, it will be described, how the frequency-domain decoded spectral values 242 can be derived from the frequency-domain channel stream data, and how the inventive context reset is involved in this calculation.

1.2.2.1 Data Structures of Frequency Domain Channel Stream

In the following, the relevant data structures of a frequency domain channel stream will be described taking reference to FIGS. 3*a*, 3*b*, 4 and 5.

FIG. 3*a* shows a graphical representation, in the form of a table, of the syntax of the frequency domain channel stream. As can be seen, the frequency domain channel stream may comprise a "global_gain" information. In addition, the frequency domain channel stream may comprise scale factor data ("scale_factor_data"), which define scale factors for different frequency bins. Regarding the global gain and the scale factor data, and their usage, reference is made to international standard ISO/IEC 14496-3(2005), part 3, sub part 4, and to the documents referenced therein.

The frequency domain channel stream may also comprise arithmetically coded spectral data ("ac_spectral_data") which will be explained in detail in the following. It should be noted that the frequency-domain channel stream may comprise additional optional information, like noise filling information, configuration information, time warp information and temporal noise shaping information, which are not of relevance for the present invention.

In the following, details regarding the arithmetically coded spectral data will be discussed taking reference to FIGS. 3*b* and 4. As can be seen in FIG. 3*b*, which shows a graphical representation in the form a table, of the syntax of the arithmetically coded spectral data "ac_spectral_data," the arithmetically coded spectral data comprise a context reset flag "arith_reset_flag" for resetting the context for the arithmetic decoding. Also, the arithmetically coded spectral data comprise one or more blocks of arithmetically encoded data "arith_data." It should be noted that an audio frame, which is represented by the syntax element "fd_channel_stream" may comprise one or more "windows," wherein the number of windows is defined by the variable "num_windows." It should be noted that one set of spectral values (also designated as "spectral coefficients") are associated with each of the windows of an audio frame, such that an audio frame comprising num_windows windows comprises num_windows sets of spectral values. Details regarding the concept of having multiple windows (and multiple sets of spectral values) within a single audio frame are described, for example, in the international standard ISO/IEC 14493-3(2005), part 3, sub part 4.

Taking reference again to FIG. 3, it can be concluded that the arithmetically coded spectral data "ac_spectral_data" of a frame, which are included in the frequency-domain channel stream "fd_channel_stream," comprise one (single) context reset flag "arith_reset_flag" and one (single) block of arithmetically coded data "arith_data," if a single window is associated with the audio frame represented by the present frequency domain channel stream. In contrast, the arithmetically coded spectral data of a frame comprise a single context rest flag "arith_reset_flag" and a plurality of blocks of arithmetically encoded data "arith_data" if the current audio frame (associated with the frequency-domain channel stream) comprises multiple windows (i.e. num_windows windows).

Taking reference now to FIG. 4, the structure of a block of arithmetically encoded data "arith_data" will be discussed taking reference to FIG. 4, which shows a graphic representation of the syntax of the arithmetically encoded data "arith_data." As can be seen from FIG. 4, the arithmetically encoded data comprise arithmetically encoded data of, for example, 1g/4 encoded tuples (wherein 1g is the number of spectral values of the current audio frame, or of the current window). For each tuple, an arithmetically encoded group index "acod_ng" is included in the arithmetically coded data "arith_data." The group index ng of a tuple of quantized spectral values a,b,c,d is, for example, arithmetically encoded (at the encoder side) in dependence on a cumulative frequencies table, which is selected in dependence on a context, as will be discussed later on. The group index ng of the tuple is arithmetically coded, wherein a so-called "arithmetic escape" ("ARITH_ESCAPE") may be used in order to extend the possible range of values.

In addition, for groups of 4-tuples having a cardinal larger than one, an arithmetic codeword "acod_ne" for decoding the index ne of the tuple within the group ng may be included within the arithmetically encoded data "arith_data." The codeword "acod_ne" may be encoded, for example, in dependent from a context.

In addition, one or more arithmetically encoded code words "acod_r" encoding one or more of the least significant bits of the values a,b,c,d of the tuple may be included in the arithmetically encoded data "arith_data."

To summarize, the arithmetically encoded data "arith_data" comprise one (or in the presence of an arithmetic escape sequence, more) arithmetic codeword "acod_ng" for encoding a group index ng taking into account a cumulative frequencies table having index pki. Optionally (depending on the cardinal of the group designated by the group index ng) the arithmetically encoded data also comprise an arithmetic codeword "acod_ne" for encoding an element index ne. Optionally, the arithmetically encoded data may also comprise one or more arithmetic code words for encoding one or more least significant bits.

The context, which determines the index (e.g. pki) of the cumulative frequencies table used for the encoding/decoding of the arithmetic codeword "acod_ng" is based on context data q[0], q[1], qs not shown in FIG. 4 but discussed below. The context information q[0], q[1], qs is either based on a default value, if the context reset flag "arith_reset_flag" is active prior to the encoding/decoding of a frame or window, or based on previously encoded/decoded spectral values (e.g. values a,b,c,d) of a previous window (if the current frame comprises a window preceding the presently considered window) or a previous frame (if the current frame comprises only one window, or if the first window within the current frame is considered). Details regarding the definition of the context can be seen in the pseudo code section labeled "obtain inter-window context information" of FIG. 4, wherein reference is also made to the definition of the procedures "arith_reset_context" and "arith_map_context" described in detail with reference to FIGS. 9*a* and 9*d* below. It should also be noted, that the pseudo code portions labeled "compute state of context" and "obtain index pki of cumulative frequencies table" serve to derive an index "pki" for selecting the "mapping information" in dependence on the context, and could be replaced by other functions for selecting the "mapping information" or "mapping rule" in dependence on the context. The functions "arith_get_context" and " arith_get_pk" will be discussed in more detail below.

It has been noted that the initialization of the context, which is described in the section "obtain-inter-window context information" is performed once (and advantageously only once) per audio frame (if the audio frame comprises only one window) or once (and advantageously only once) per window (if the current audio frame comprises more than one window).

Accordingly, a reset of the entire context information q[0], q[1], qs (or the alternative initialization of the context information q[0] on the basis of the decoded spectral values of the previous frame (or previous window)) is advantageously performed only once per block of arithmetically encoded data (i.e. only once per window if the present frame comprises only one window, or only once per window, if the present frame comprises more than one window).

In contrast, the context information q[1] (which is based on the previously decoded spectral values of the current frame or window) is updated upon completion of a decoding of a single tuple of spectral values a, b, c, d, for example as defined by the procedure "arith_update_context."

For further details regarding the payloads of the "spectral noiseless coder" (i.e. for encoding the arithmetically encoded spectral values) reference is made to the definitions as given in the tables of FIG. 5.

To summarize, spectrum coefficients (e.g. a, b, c, d) from both the "linear prediction domain" coded signal 224 and the "frequency-domain" coded signal 222 are scalar quantized and then noiselessly coded by an adaptively context dependent arithmetic coding (for example an encoder providing the entropy coded audio signal 210). The quantized coefficients (e.g. a, b, c, d) are gathered together in 4-tuples before being transmitted (by the encoder) from the lowest-frequency to the highest-frequency. Each 4-tuple is split into the most significant 3-bits (one bit for the sign and 2 for the amplitude) wise plane and the remaining less significant bit-planes. The most significant 3-bits wise plane is coded according to its neighborhood (i.e. taking into consideration the "context") by means of the group index, ng, and the element index, ne. The remaining less significant bit-planes are entropy coded without considering the context. The indexes ng and ne and the less significant bit-planes form the samples of the arithmetic coder (which are evaluated by the entropy decoder 240). Details regarding the arithmetic coding will be described below in the section 1.2.2.2.

1.2.2.2 Method for Decoding of the Frequency-Domain Channel Stream

In the following, the functionality of the context-based entropy decoder 120, 240, comprising the context resetter 130, will be described in detail taking reference to FIGS. 6, 7, 8, 9*a*-9*f* and 20.

It should be noted that it is the function of the context-based entropy decoder to reconstruct (decode) an entropy decoded (advantageously arithmetically decoded) audio information (e.g. spectral values a, b, c, d of a frequency-domain representation of the audio signal, or of a linear-prediction-domain transform-coded-excitation representation of the audio signal) on the basis of an entropy encoded (advantageously arithmetically encoded) audio information (e.g. encoded spectral values). The context-based entropy decoder (comprising the context resetter) may for example be configured to decode spectral values a, b, c, d encoded as described by the syntax shown in FIG. 4.

Figures 4A, 4B:
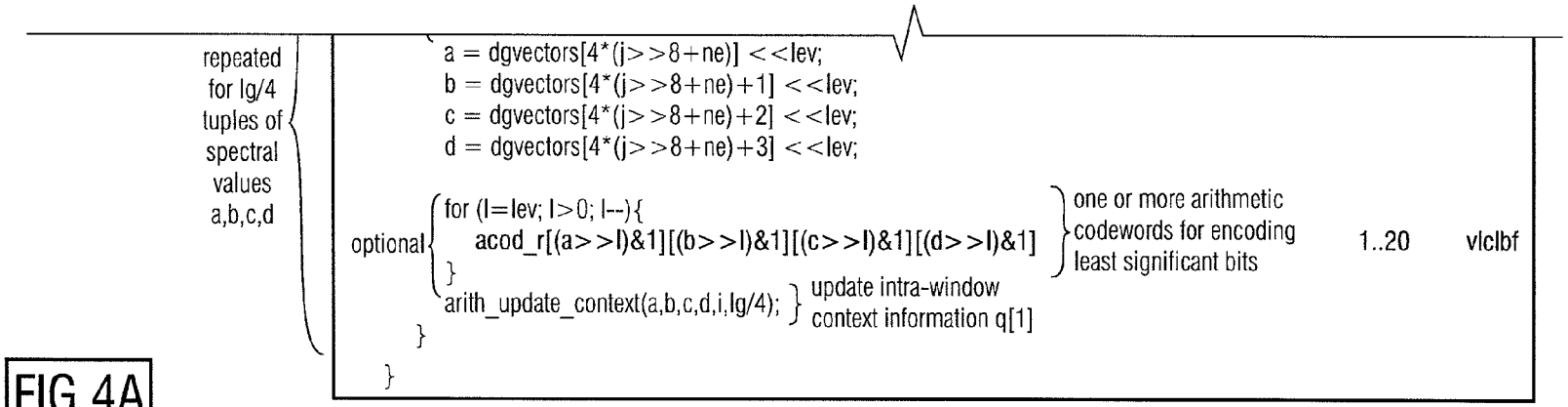
FIG. 4 shows a graphical representation, in the form of a syntax representation, of arithmetically coded data, which may be comprised by the arithmetically coded spectral data represented in FIG. 3*b*, or by the transform-coded-excitation data represented in FIG. 11*b;*

It should also be noted that the syntax shown in FIG. 4 may be considered as a decoding rule, in particular when taken in combination with the definition of FIGS. 5, 7, 8 and 9*a*-9*f* and 20, such that the decoder is generally configured to decode information encoded according to FIG. 4.

Figure 6:
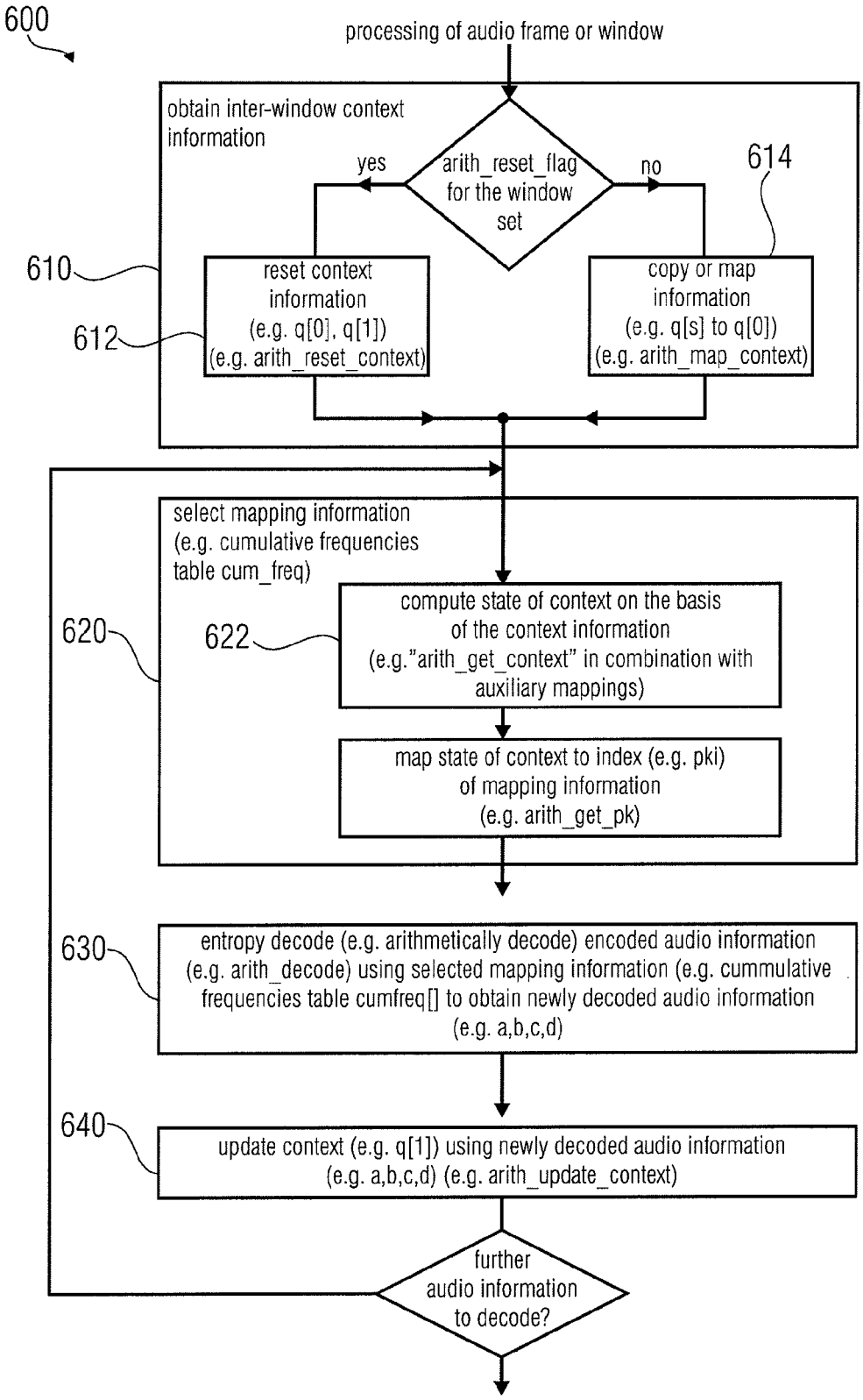
FIG. 6 shows a flow chart of a method for processing an audio frame, which can be used in an embodiment of the invention.

Taking reference now to FIG. 6, which shows a flow chart of a simplified decoding algorithm for the processing of an audio frame or of a window within an audio frame, the decoding will be described. The method 600 of FIG. 6 may comprise a step 610 of obtaining an inter-window context information. For this purpose, it may be checked whether the context reset flag "arith_reset_flag" is set for the current window (or current frame, if the frame only comprises one window). If the context reset flag is set, the context information may be reset in step 612, for example by executing the function "arith_reset_context" discussed below. In particular, the portion of the context information describing the coded values of a previous window (or previous frame) may be set to default value (e.g. 0 or −1) in the step 612. In contrast, if it is found that the context reset flag is not set for the window (or frame), context information from a previous frame (or a window) may be copied, or mapped, to be used for determining (or influencing) the context for the decoding of the arithmetically encoded spectral values of the present window (or frame). The step 614 may correspond to the execution of the function "arith_map_context." When executing said function, the context may be mapped even if the current frame (or window) and the previous frame (or window) comprise different spectral resolutions (even though this functionality is not absolutely required).

Subsequently, a plurality of arithmetically encoded spectral values (or tuples of such values) may be decoded by performing steps 620, 630, 640 one or more times. In step 620, a mapping information (for example a Huffmann codebook, or a cumulative frequencies table "cum_freq") is selected on the basis of the context as established in step 610 (and optionally updated in the step 640). The step 620 may comprise a one-or-more step method for determining the mapping information. For example, the step 620 may comprise a step 622 of computing the state of the context on the basis of the context information (e.g. q[0], q[1]). The computation of the state of the context may for example be performed by the function "arith_get_context," which is defined below. Optionally, an auxiliary mapping may be performed (for example as seen in the pseudo code portion labeled "compute state of context" of FIG. 4). Further, the step 620 may comprise a sub-step 624 of mapping the state of the context (e.g. the variable t as shown in the syntax of FIG. 4) to an index (for example designated "pki") of a mapping information (for example designating a row or column of the cumulative frequencies table). For this purpose, it is, for example, possible to evaluate the function "arith_get_pk." To summarize, the step 620 allows to map the current context (q[0],q[1]) onto an index (e.g. pki) describing which mapping information (out of a plurality of discreet sets of mapping information) should be used for the entropy decoding (e.g. arithmetic decoding). The method 600 also comprises a step 630 of entropy decoding of encoded audio information (for example the spectral values a, b, c, d) using the selected mapping information (for example one cumulative frequencies table out of a plurality of cumulative frequencies tables) to obtain a newly decoded audio information (e.g. spectral values a, b, c, d). For entropy decoding the audio information, the function "arith_decode" explained in detail below, may be used.

Subsequently, the context may be updated in the step 640 using the newly decoded audio information (for example using one or more spectral values a, b, c, d). For example, a portion of the context representing previously encoded audio information of the present frame or window (e.g. q[1]) may be updated. For this purpose, the function "arith_update_context" detailed below may be used.

As mentioned above, steps 620, 630, 640 may be repeated.

Entropy decoding the encoded audio information may comprise using one or more arithmetic code words (e.g. "acod_ng," "acod_ne" and/or "acod_r") comprised by the entropy encoded audio information 222, 224, for example as represented in FIG. 4.

Figure 7:
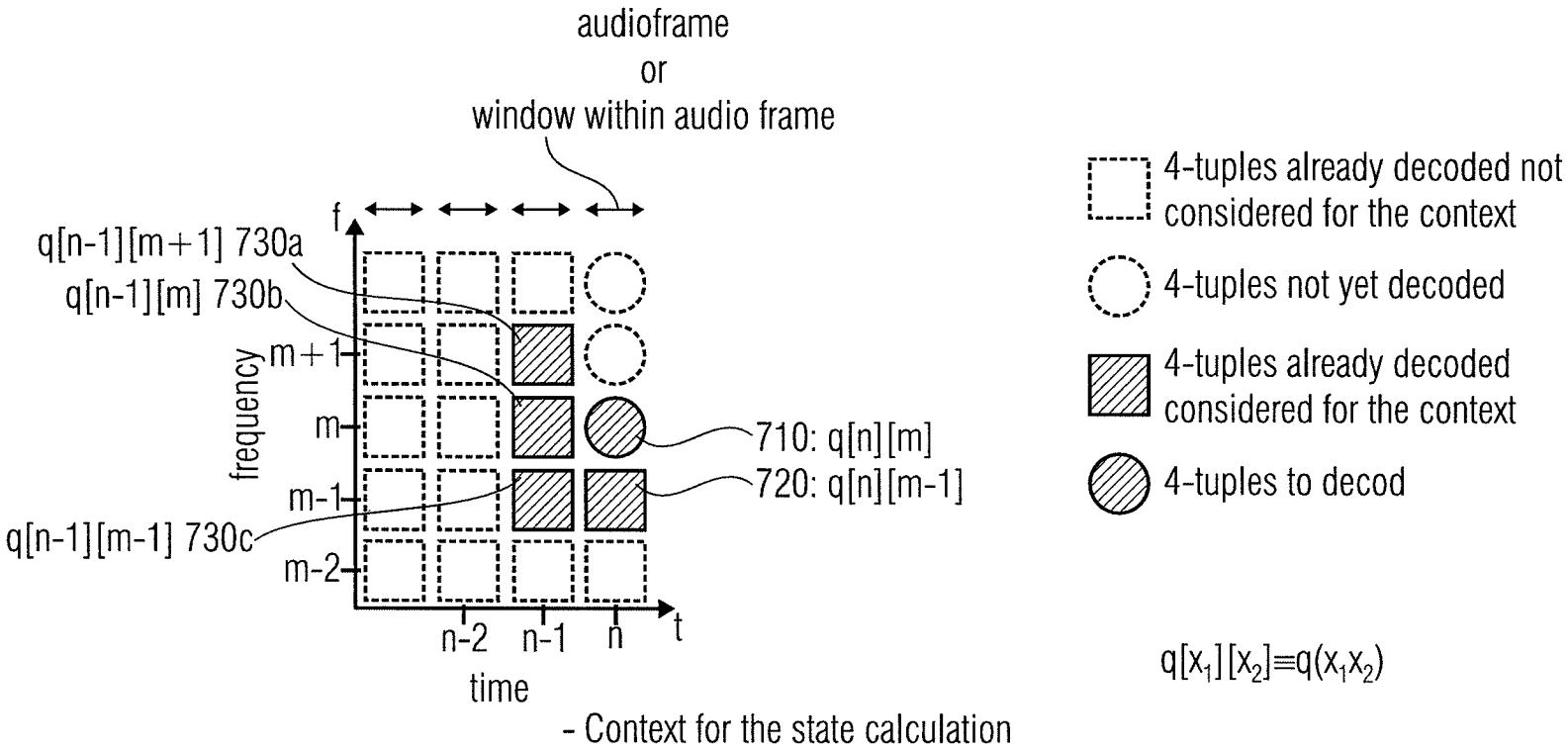
FIG. 7 shows a graphical representation of a context for a calculation of a state for selecting a mapping information.

In the following, an example of the context considered for the state calculation (state of the context) will be described taking reference to FIG. 7. Generally speaking, it can be said that the spectral noiseless coding (and the corresponding spectral noiseless decoding) is used (for example in the encoder) to further reduce the redundancy of the quantized spectrum (and is used in the decoder to reconstruct the quantized spectrum). The spectrum noiseless coding scheme is based on an arithmetic coding in conjunction with a dynamically adapted context. The noiseless coding is set by the quantized spectral values (e.g. a, b, c, d) and uses context dependent cumulative frequencies tables (e.g. cum_freq) derived from, for example, 4 previously decoded neighboring 4-tuples. Here, neighborhood in both time and frequency is taken into account, as illustrated in FIG. 7. The cumulative frequencies tables (which are selected in dependence on the context) are then used by the arithmetic encoder to generate a variable length binary code (and also by the arithmetic decoder in order to decode the variable length binary code).

Taking reference now to FIG. 7, it can bee seen that a context for decoding a 4-tuple to decode 710 is based on a 4-tuple 720 already decoded and adjacent in frequency to the 4-tuple 710 to decode and associated with the same audio frame or window like the 4-tuple 710 to decode. In addition, the context of the 4-tuple to decode 710 is also based on three additional 4-tuples 730*a*,730*b*,730*c* already decoded and associated with an audio frame or window preceding the audio frame or window of the 4-tuple 710 to decode.

Regarding the arithmetic encoding and arithmetic decoding, it should be noted that the arithmetic coder produces a binary code for a given set of symbols (e.g. spectral values a, b, c, d) and their respective probabilities (as defined, for example, by the cumulative frequencies tables). The binary code is generated by mapping a probability interval, where a set of symbols (e.g. a,b,c,d) lies, to a code word. Inversely, the set of samples in (e.g. a, b, c, d) are derived from the binary code by an inverse mapping, wherein the probability of the samples (e.g. a, b, c, d) is taken into account (for example by selecting a mapping information, like a cumulative frequencies distribution, on the basis of the context). In the following, the decoding process, i.e. the process of arithmetic decoding, which may be performed by the context based entropy decoder 120 or by the entropy decoder/context resetter 240, and which has been generally described taking reference to FIG. 6, will be explained taking reference to FIG. 9*a*-9*f*.

For this purpose, reference is made to the definitions shown in the table of FIG. 8. In the table of FIG. 8, definitions of data, variables and help elements used in the pseudo program codes of FIGS. 9*a*-9*f* are defined. Reference is also made to the definitions of FIG. 5 and to the above discussion.

Regarding the decoding process, it can be said that 4-tuples of quantized spectral coefficients are noiselessly coded (by the encoder) and transmitted (via a transmission channel or storage medium between the encoder and the decoder discussed here) starting from the lowest-frequency coefficient and progressing to the highest-frequency coefficient.

The coefficients from the advanced audio coding (AAC) (i.e. the coefficients of the frequency-domain channel stream data) are stored in an array "x_ac_quant[g][win][sfb][bin],"

in the order of transmission of the noiseless coding code word is such that when they are decoded in the order received and stored in the array, [bin] if the most rapidly incrementing index and [g] is the most slowly incrementing index. Within a codeword the order of decoding is a, b, c, d.

The coefficient from the transform-coded-excitation (TCX) (e.g. of the linear-prediction-domain channel stream data) are stored directly in the array "x_tcx_invquant[win][bin]," and the order of the transmission of the noiseless coding code words is such that when they are decoded in the order received and stored in the array, bin if the most rapidly incrementing index and win if the most slowly incrementing index. Within a codeword, the order of decoding is a, b, c, d.

First, the flag "arith_reset_flag" is evaluated. The flag "arith_reset_flag" determines if the context may be reset. If the flag is TRUE, the function "arith_reset_context," which is shown in the pseudo program code representation of FIG. 9*a* if called. Otherwise, when the "arith_reset_flag" is FALSE, a mapping is done between the past context (i.e. the context determined by decoded audio information of the previously decoded window or frame) and the current context. For this purpose, the function "arith_map_context," which is represented in the pseudo program code representation of FIG. 9*b*, is called (thereby allowing for the reuse of the context even if the previous frame or window comprises a different spectral resolution). However, it should be noted that the call of the function "arith_map_context" should be considered as being optional.

The noiseless decoder (or entropy decoder) outputs 4-tuples of signed quantized spectral coefficients. At first, the state of the context is calculated based on the four previously decoded groups "surrounding" (or, more precisely, neighboring) the 4-tuple to decode (as shown in FIG. 7 at reference numerals 720,730*a*,730*b*,730*c*). The state of the context is given by the function "arith_get_context( )" which is represented by the pseudo program code representation of FIG. 9*c*. As can be seen, the function "arith_get_context" allocates a context state value s to the context in dependence on the values "v" (as defined in the pseudo program code of FIG. 9*f*).

Once the state s is known, the group to which belongs the most significant 2-bits wise plane of 4-tuple is decoded using the function "arith_decode( )" fed with (or configured to use) the appropriate (selected) cumulative frequencies table corresponding to the context state. The correspondence is made by the function "arith_get_pk( )" which is represented by the pseudo code representation of FIG. 9*d*.

To summarize, the functions "arith_get_context" and "arith_get_pk" allow the obtain a cumulative frequencies table index pki on the basis of the context (namely q[0][1+i], q[1][1+i−1], q[s][1+i−1], q[0][1+i+1]). Thus, it is possible to select mapping information (namely one of the cumulative frequencies tables) in dependence on the context.

Then (once the cumulative frequencies table is selected) the "arith_decode( )" function is called with the cumulative frequencies table corresponding to the index returned by the "arith_get_pk( )" The arithmetic decoder is an integer implementation generating tag with scaling. The pseudo C-code shown in FIG. 9*e* describes the used algorithm.

Taking reference to the algorithm "arith_decode" shown in FIG. 9*e*, it should be noted that it is assumed that an appropriate cumulative frequencies table is selected on the basis of the context. It should also be noted that the algorithm "arith_decode" conducts the arithmetic decoding using the bits (or bit sequences) "acod_ng," "acod_ne" and "acod_r" defined in FIG. 4. Also, it should be noted that the algorithm "arith_decode" may use a cumulative frequencies table "cum_freq" defined by the context for a decoding of a first occurrence of the bit sequence "acod_ng" related to a tuple. However, additional occurrences of the bit sequences "acod_ng" for the same tuple (which may follow after and arith_escape-sequence) may for example be decoded using a different cumulative frequencies table or even a default cumulative frequencies table. Further, it should be noted that the decoding of the bit sequences "acod_ne" and "acod_r" may be performed using appropriate cumulative frequencies table, which may be independent from the context. Thus, to summarize, a context-dependent cumulative frequencies table may be applied (unless the context is reset, such that a context-reset-state is reached and a default cumulative frequencies table is used) for decoding of the arithmetic codeword "acod_ng" for decoding the group index (at least until an arithmetic escape is recognized).

This can be seen when considering the graphic representation of the syntax of "arith_data", which is given in FIG. 4, when seen in combination with the pseudo program code of the function "arith_decode" given in FIG. 9*e*. An understanding of the decoding can be obtained on the basis of an understanding of the syntax of "arith_data."

While the decoded group index ng is the "escape" symbol, "ARITH_ESCAPE," an additional group index ng is decoded and the variable lev is incremented by two. Once the decoded group index is not the escape, "ARITH_ESCAPE," the number of elements, mm, within the group and the group offset, og, are deduced by looking up to the table "dgroups[ ]":

$$mm=dgroups[nq]\&255$$

$$og=dgroups[nq]>>8$$

The element index ne is then decoded by calling the function "arith_decode( )" with the cumulative frequencies table (arith_cf_ne+((mm*(mm−1))>>1)[]. Once the element index is decoded, the most significant 2-bits wise plane of the 4-tuple can be derived with the table "dgvector[ ]:"

$$a=dgvectors[4*(og+ne)]$$

$$b=dgvectors[4*(og+ne)+1]$$

$$c=dgvectors[4*(og+ne)+2]$$

$$d=dgvectors[4*(og+ne)+3]$$

The remaining bit planes (for example the least significant bits) are then decoded from the most significant to the lowest significant level by calling lev times "arith_decode( )" with the cumulative frequencies table "arith_cf_r[ ]" (which is a predefined cumulative frequencies table for the decoding of the least significant bits, and which may indicate equal frequencies of the bit combinations). The decoded bit plane r permits to refine the decode 4-tuple by the following way:

$$a=(a<<1)|(r\&1)$$

$$b=(b<<1)|((r>>1)\&1)$$

$$c=(c<<1)|((r>>2)\&1)$$

$$d=(d<<1)|(r>>3)$$

Once the 4-tuple (a, b, c, d) is completely decoded, the context tables q and qs are updated by calling the function "arith_update_context( )" which is represented by the pseudo program code representation of FIG. 9*f*.

As can be seen from FIG. 9*f*, the context representing the previously decoded spectral values of the current window or frame, namely q[1], are updated (for example each time a new tuple of spectral values is decoded). In addition, the function "arith_update_context" also comprises a pseudo code section for updating the context history qs, which is performed only once per frame or window.

To summarize, the function "arith_update_context" comprises two main functionalities, namely to update the context portion (e.g. q[1]) representing previously decoded spectral values of the current frame of window, as soon as a new spectral value of the current frame or window is decoded, and to update the context history (e.g. qs) in response to the completion of the decoding of a frame or window, such that the context history qs can be used to derive a context portion (e.g. q[0]) which represents an "old" context when decoding the next frame or window.

As can be seen in the pseudo program code representation of FIGS. 9*a* and 9*b*, the context history (e.g. qs) is either discarded, namely in the case of a context reset, or used for obtaining the "old" context portion (e.g. q[0]), namely if there is not context reset, when proceeding to the arithmetic decoding of a next frame or window.

Figure 20:
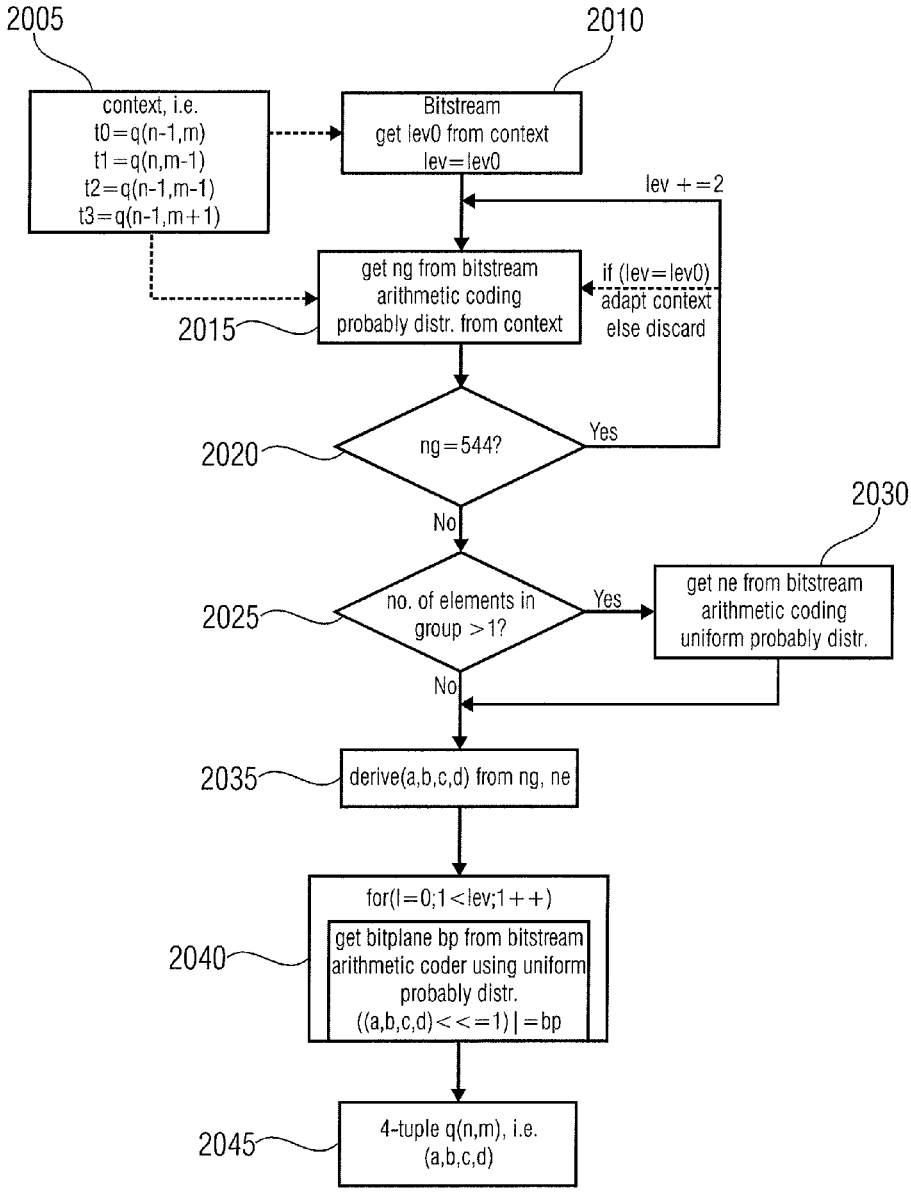
FIG. 20 shows a flow chart of a method for a context-dependent arithmetic decoding of tuples of spectral values, which can be used in the inventive audio decoders.

In the following, the method of arithmetic decoding will be briefly summarized taking reference to FIG. 20, which illustrates a flowchart of the embodiment of the decoding scheme. In step 2005, corresponding to step 2105, the context is derived on the basis of t0, t1, t2 and t3. In step 2010, the first reduction level lev0 is estimated from the context, and the variable lev is set to lev0. In the following step 2015, the group ng is read from the bitstream and the probability distribution for decoding ng is derived from the context. In step 2015, the group ng can then be decoded from the bitstream. In step 2020 it is determined whether the ng equals 544, which corresponds to the escape value. If so, the variable lev can be increased by 2 before returning to step 2015. In case this branch is used for the first time, i.e., if lev==lev0, the probability distribution respectively the context can be accordingly adapted, respectively discarded if the branch is not used for the first time, in line with the above described context adaptation mechanism. In case the group index ng is not equal to 544 in step 2020, in a following step 2025 it is determined whether the number of elements in a group is greater than 1, and if so, in step 2030, the group element ne is read and decoded from the bitstream assuming a uniform probability distribution. The element index ne is derived from the bitstream using arithmetic coding and a uniform probability distribution. In step 2035 the literal codeword (a,b,c,d) is derived from ng and ne, for example, by a look-up process in the tables, for example, refer to dgroups[ng] and acod_ne[ne]. In step 2040 for all lev missing bitplanes, the planes are read from the bitstream using arithmetic coding and assuming a uniform probability distribution. The bitplanes can then be appended to (a,b,c,d) by shifting (a,b,c,d) to the left and adding the bitplane bp: ((a,b,c,d)<<=1)|=bp. This process may be repeated lev times. Finally in step 2045 the 4-tuple q(n,m), i.e.(a,b,c,d) can be provided.

1.2.2.3 Course of the Decoding

In the following, the course of the decoding will be briefly discussed for different scenarios taking reference to FIGS. 10*a*-10*d*.

Figure 10A:
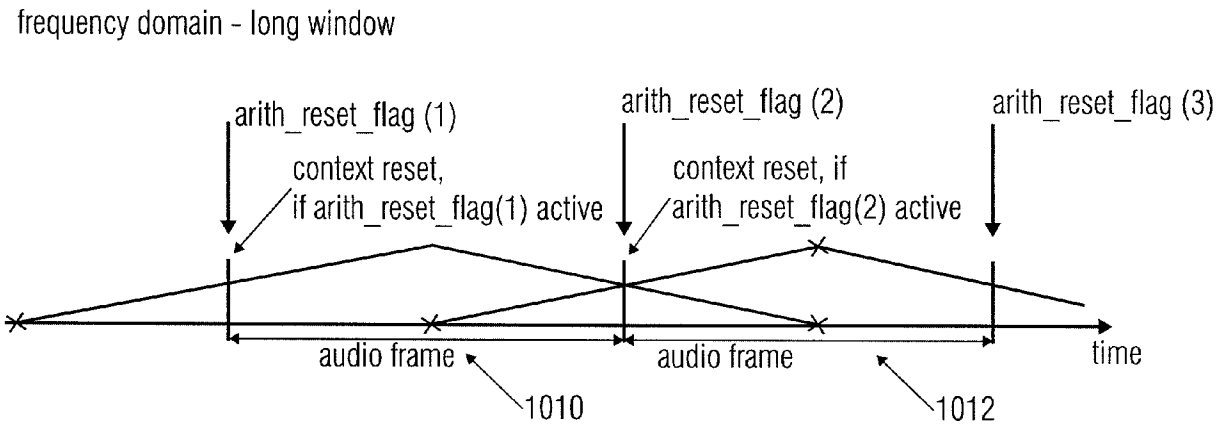
FIG. 10*a* shows a graphical representation of a context reset in the presence of audio frames having associated therewith "long windows" (one long window per audio frame)

FIG. 10*a* shows a graphical representation of the course of the decoding for an audio frame being frequency-domain encoded using a so-called "long window." Regarding the encoding, reference is made to International Standard IOC/IEC 14493-3(2005), part 3, sub-part 4. As can be seen, the audio contents of a first frame 1010 are closely related, and the time-domain signals reconstructed for the audio frames 1010, 1012 are overlapped-and-added (as defined in said standard). One set of spectral coefficients is associated to each of the frames 1010, 1012, as is known from the above referenced standard. Further, a novel 1-bit context reset flag ("arith_reset_flag") is associated with each of the frames 1010, 1012. If the context reset flag associated with the first frame 1010 is set, the context is reset (e.g. according to the algorithm shown in FIG. 9*a*) prior to the arithmetic decoding of the set of spectral values of the first audio frame 1010. Similarly, if the 1-bit context reset flag of the second audio frame 1012 is set, the context is reset, to be independent from the spectral values of the first audio frame 1010, before decoding the spectral values of the second audio frame 1012. Thus, by evaluating the context reset flag, is possible to reset the context for decoding the second audio frame 1012, even though the first audio frame 1010 and the second audio frame 1012 are closely related in that the windowed time domain audio signals derived from the spectral values of said audio frames 1010, 1012 are overlapped and added, and even though identical window shapes are associated with the first and second audio frame 1010, 1012.

Figure 10B:
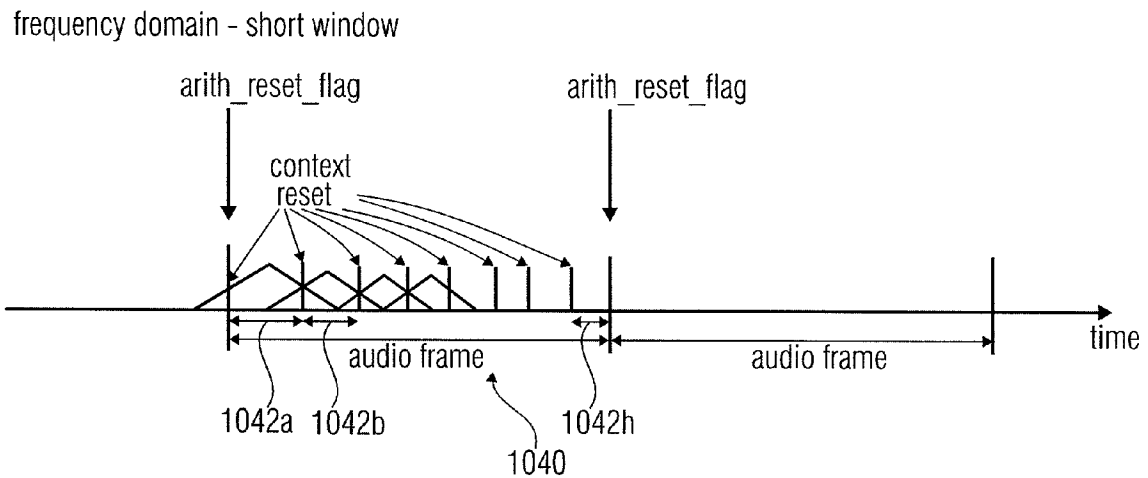
FIG. 10*b* shows a graphical representation of a context reset for audio frames having associated therewith a plurality of "short windows" (e.g. eight short windows per audio frame)

Taking reference now to FIG. 10*b*, which shows a graphical representation of the decoding of an audio frame 1040 having associated therewith a plurality of (for example 8) short windows, a reset of the context for this case will be described. Again, there is a single 1-bit context reset flag associated with the audio frame 1040, even though a plurality of short windows are associated with the audio frame 1040. Regarding the short windows, it should be noted that one set of spectral values is associated with each of the short windows, such that the audio frame 1040 comprise a plurality of (for example 8) sets of (arithmetically encoded) spectral values. However, if the context reset flag is active, the context will be reset before the decoding of the spectral values of the first window 1042*a* of the audio frame 1040 and between the decoding of the spectral values of any subsequent frames 1042*b*-1042*h* of the audio frame 1040. Thus, once again, the context is reset between a decoding of the spectral values of two subsequent windows, the audio contents of which are closely related (in that they are overlapped and added), and even though the subsequent windows (e.g. windows 1042*a*, 1042*b*) comprise identical window shapes associated therewith. Also, it should be noted that the context is reset during the decoding of a single audio frame (i.e. between the decoding of different spectral values of a single audio frame). Also, it should be noted that a single bit context reset flag calls a multiple reset of the context if a frame 1040 comprises a plurality of short windows 1042*a*-1042*h*.

Figure 10C:
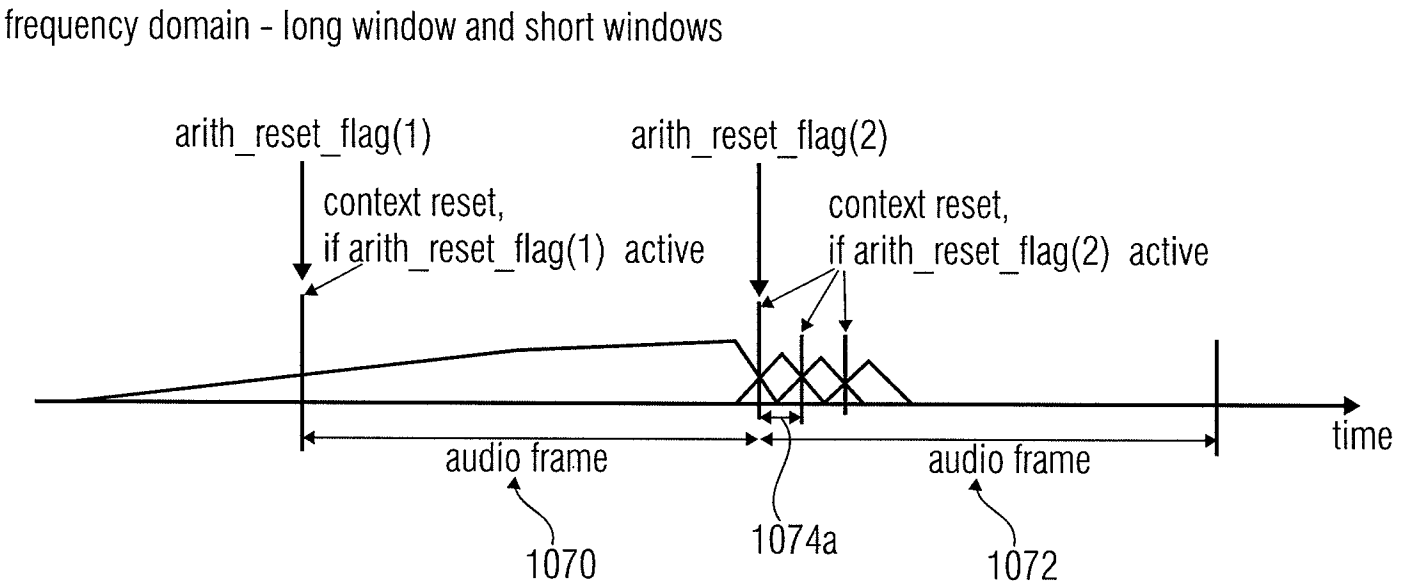
FIG. 10*c* shows a graphical representation of a context reset at a transition between a first audio frame having associated therewith a "long start window" and an audio frame having associated therewith a plurality of "short windows;"

Taking reference now to FIG. 10*c*, which shows a graphical representation of a context reset in the presence of a transition from audio frames being associated with long windows (audio frame 1070 and preceding audio frames) to one or more audio frames being associated with a plurality of short windows (audio frame 1072). It should be noted that the context reset flag allows for a signaling of the need to reset the context independent from a signaling of the window shape. For example, the entropy decoder may be configured to be capable of obtaining the spectral values of a first window 1074*a* of the audio frame 1072 using a context, which is based on spectral values of the audio frame 1070, even though the window shape of the "window" (or, more precisely, frame portion or "subframe" associated with a short window) 1074*a* is substantially different from the window shape of the long window of the audio frame 1070, and even though the spectral resolution of the short window 1074*a* is typically smaller than the spectral resolution (frequency resolution) of the long window of the audio frame 1070. This can be obtained by the mapping of the context between windows (or frames) of different spectral resolution, which is described by the pseudo program code of FIG. 9*b*. However, the entropy decoder is at the same time capable of resetting the context between the decoding of the spectral values of the long window of the audio frame 1070 and the spectral values of the first short window 1074*a* of the audio frame 1072, if it is found that the context reset flag of the audio frame 1072 is active. The reset of the context is in this case performed by an algorithm, which has been described with reference to the pseudo program code of FIG. 9*a*.

To summarize the above, the evaluation of the context reset flag provides the inventive entropy decoder with a very large flexibility. In an advantageous embodiment, the entropy decoder is capable of:

- using a context, which is based on a previously decoded frame or window of a different spectral resolution when decoding (the spectral values of) a current frame or window; and
- selectively resetting, in response to the context reset flag, the context between a decoding of (spectral values of) frames or windows having different window shapes and/or different spectral resolutions; and
- selectively resetting, in response to the context reset flag, the context between a decoding of (spectral values of) frames or windows having the same window shape and/or spectral resolution.

In other words, the entropy decoder is configured to perform the context reset independent from a change of the window shape and/or spectral resolution, by evaluating the context reset side information separate from the window shape/spectral resolution side information.

1.2.3 Linear Prediction Domain Channel Stream Decoding 1.2.3.1 Linear Prediction Domain Channel Stream Data In the following, the syntax of a linear-prediction-domain channel stream will be described taking reference to FIG. 11*a*, which shows a graphical representation of the syntax of a linear-prediction-domain channel stream, and also to FIG. 11*b*, which shows a graphical representation of the syntax of a transform-coded-excitation coding (tcx_coding) and also to FIGS. 11*c* and 11*d* which show a representation of definitions and data elements used in the syntax of the linear-prediction-domain channel stream.

Taking reference now to FIG. 11*a* the overall structure of the linear-prediction-domain channel stream will be discussed. The linear-prediction-domain channel stream show in FIG. 11*a* comprises a number of configuration information items, like, for example, "acelp_core_mode" and "lpd_mode." Regarding the meaning of the configuration elements, and the overall concept of the linear-prediction-domain coding, reference is made to International Standard 3GPP TS 26.090, 3GPP TS 26.190 and 3GPP TS 26.290, Furthermore, it should be noted that he linear-prediction-domain channel stream may comprise up to four "blocks" (having indices k=0 to k=3) which comprise either an ACELP-encoded excitation or a transform-coded-excitation (which may itself be arithmetically coded). Taking reference again to FIG. 11*a*, it can be seen that the linear-prediction-domain channel stream comprises, for each of the "blocks," a ACELP stimulus encoding or a TCX stimulus encoding. As the ACELP stimulus encoding is not relevant for the present invention, a detailed discussion will be omitted and reference will be made to the above international standards regarding this issue.

Regarding the TCX stimulus encoding, it should be noted that different encodings are used for encoding a first TCX "block" (also designated as "TCX frame") of the current audio frame and for the encoding of any subsequent TCX "blocks" (TCX frames) of the current audio frame. This is indicated by the so-called "first_tcx_flag," which indicates if the currently processed TCX "block" (TCX frame) is the first in the present frame (also designated as "super frame" in the terminology of linear-prediction-domain coding).

Taking reference now to FIG. 11*b*, it can be seen that the encoding of a transform-coded-excitation "block" (tcx frame) comprises an encoded noise factor ("noise_factor") and an encoded global gain ("global_gain"). In addition, if the presently considered tcx "block" is the first tcx "block" within the currently considered audio frame, the encoding of the currently considered tcx comprises a context reset flag ("arith_reset_flag"). Otherwise, i.e. if the presently considered tcx "block" is not the first tcx "block" of the current audio frame, the encoding of the current tcx "block" does not comprise such a context reset flag, as can be seen from the syntax description of FIG. 11*b*. Furthermore, the encoding of the tcx stimulus comprises arithmetically encoded spectral values (or spectral coefficients) "arith_data", which are encoded in accordance with the arithmetic coding already explained with reference to FIG. 4 above.

The spectral values representing the transform-coded-excitation stimulus of a first tcx "block" of an audio frame are encoded using a reset context (default context) if the context reset flag ("arith_reset_flag") of said tcx "block" is active. The arithmetically encoded spectral values of a first tcx "block" of an audio frame are encoded using a non-reset context if the context reset flag of said audio frame is inactive. The arithmetically encoded values of any subsequent tcx "blocks" (subsequent to the first tcx "block") of an audio frame are encoded using a non-reset context (i.e. using a context derived from a previous tcx block). Said details regarding the arithmetic encoding of the spectral values (or spectral coefficients) of the transform-coded-excitation can be seen in FIG. 11*b* when taken in combination with FIG. 11*a*.

1.2.3.2 Method for Decoding of the Transform-Coded-Excitation Spectral Values

The transform-coded-excitation spectral values, which are arithmetically encoded, can be decoded taking into account the context. For example, if the context reset flag of a tcx "block" is active, the context may be reset, for example, in accordance with the algorithm shown in FIG. 9*a*, before decoding the arithmetically encoded spectral values of the tcx "block" using the algorithm described with reference to FIG. 9*c*-9*f*. In contrast, if the context reset flag of a tcx "block" is inactive, the context for decoding may be determined by the mapping (of the context history from a previously decoded tcx block) described with reference to FIG. 9*b*, or by deriving the context from the previously decoded spectral values in any other form. Also, the context for the decoding of the "subsequent" tcx "blocks", which are not the first tcx "block" of an audio frame, may be derived from previously decoded spectral values of previous tcx "blocks."

For the decoding of tcx excitation stimulus spectral values, the decoder may therefore use the algorithm, which has been explained, for example, with reference to FIGS. 6, 9*a*-9*f* and 20. However, the setting of the context reset flag ("arith_reset_flag") is not checked for every tcx "block" (which corresponds to a "window"), but only for the first tcx "block" of an audio frame. For the subsequent tcx "blocks" (which correspond to "windows") it may be assumed that the context shall not be reset.

Accordingly, the tcx excitation stimulus spectral value decoder may be configured to decode spectral values encoded according to the syntax shown in FIGS. 11*b* and 4.

1.2.3.3 Course of the Decoding

In the following, a decoding of a linear-prediction-domain excitation audio information will be described taking reference to FIG. 12. However, the decoding of the parameters (e.g. of parameters of the linear predictor excited by the stimulus or excitation) of the linear-prediction-domain signal synthesizer will be neglected here. Rather, the focus of the following discussion is put on the decoding of the transform-coded-excitation stimulus spectral values.

Figure 12:
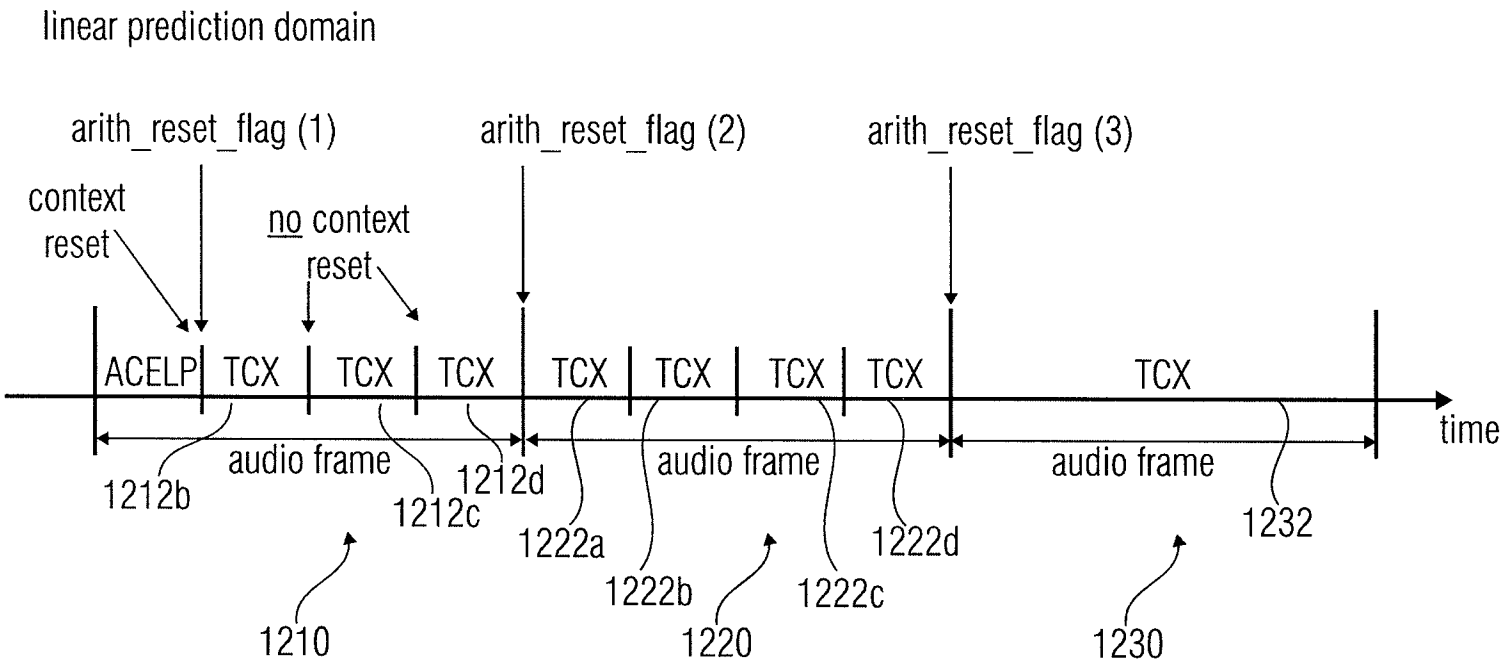
FIG. 12 shows a graphical representation of a context reset for audio frames comprising a linear-prediction-domain excitation coding.

FIG. 12 shows a graphical representation of the encoded excitation for exciting a linear-prediction-domain audio synthesizer. The encoded stimulus information is shown for subsequent audio frames 1210, 1220, 1230. For example, the first audio frame 1210 comprises a first "block" 1212*a* which comprises an ACELP-encoded stimulus. The audio frame 1210 also comprises three "blocks" 1212*b*,1212*c*,1212*d* comprising transform-coded excitation stimulus, wherein the transform-coded-excitation stimulus of each of the TCX "blocks" 1212B, 1212C, 1212D comprises a set of arithmetically encoded spectral values. In addition, the first TCX block 1212B of the frame 1210 comprises a context reset flag "arith_reset_flag". The audio frame 1220 comprises, for example, four TCX "blocks" 1222A-1222D, wherein the first TCX block 1222A of the frame 1220 comprises a context reset flag. The audio frame 1230 comprises a single TCX block 1232, which itself comprises a context reset flag. Accordingly, there is one context reset flag per audio frame comprising one or more TCX blocks.

Accordingly, when decoding the linear-prediction-domain stimulus shown in FIG. 12, the decoder will check whether the context reset flag of the TCX block 1212B is set and reset the context prior to the decoding of the spectral values of the TCX block 1212B, in dependence on the state of the context reset flag. However, there will be no reset of the context between arithmetic decoding of these spectral values of the TCX blocks 1212B, and 1212C, independent from the state of the context reset flag of the audio frame 1210. Similarly, there will be no reset of the context between the decoding of the spectral values of the TCX blocks 1212C, and 1212D. However, the decoder will reset the context before the decoding of the spectral values of the TCX block 1222A in dependence on the status of the context reset flag of the audio frame 1222 and will not conduct a reset of the context between the decoding of the spectral values of the TCX blocks 1222A and 1222B, 1222B and 1222C, 1222C and 1222D. However, the decoder will perform a reset of the context prior to decoding of the spectral values of the TCX block 1232 in dependence on the status of the context reset flag of the audio frame 1230.

It should be also noted that an audio stream may comprise a combination of frequency-domain audio framed and linear prediction-domain audio frames, such that the decoder may be configured to properly decode such an alternating sequence. At a transition between different encoding modes (frequency-domain vs. linear prediction domain), a reset of the context may or may not be enforced by the context resetter.

1.3. Audio Decoder—Third Embodiment

In the following another audio decoder concept will be described, which allows for a bitrate-efficient resetting of the context even in the absence of a dedicated context reset side information.

It has been found that the side information, which accompanies the entropy encoded spectral values, can be exploited for deciding whether to reset the context for entropy-decoding (e.g. arithmetical decoding) of the entropy encoded spectral values.

An efficient concept for resetting the context of the arithmetic decoding has been found for audio frames in which sets of spectral values associated with a plurality of windows are comprised. For example, the so-called "advanced audio coding" (also briefly designated as "AAC"), which is defined in the international standard ISO/IEC 14496-3:2005, part 3, subpart 4, uses audio frames comprising eight sets of spectral coefficients, wherein each set of spectral coefficients is associated to one "short window". Accordingly, eight short windows are associated with such an audio frame, wherein the eight short windows are used in an overlap-and-add procedure for overlapping-and-adding windowed time domain signals reconstructed on the basis of the sets of spectral coefficients. For details, reference is made to said international standard. However, in an audio frame comprising a plurality of sets of spectral coefficients, two or more of the sets of spectral coefficients may be grouped, such that common scale factors are associated with the grouped sets of spectral coefficients (and are applied thereto in the decoder). The grouping of sets of spectral coefficients may for example be signaled using a grouping side information (e.g. "scale_factor_grouping" bits). For details, reference is made, for example, to ISO/IEC 14496-3:2005(E), part 3, subpart 4, tables 4.6, 4.44, 4.45, 4.46 and 4.47. Nevertheless, in order to provide a full understanding, reference is made to the above-mentioned international standard in its entirety.

However, in an audio decoder according to an embodiment of the invention, the information regarding the grouping of different sets of spectral values (for example, by associating them with common scale spectral values) may be used for determining when to reset the context for the arithmetic encoding/decoding of the spectral values. For example, an inventive audio decoder according to the third embodiment might be configured to reset the context of the entropy decoding (e.g. of a context-based Huffmann-decoding or a context-based arithmetic decoding, as described above) whenever it is found that there is a transition from one group of sets of encoded spectral values to another group of sets of spectral values (to which other group of sets new scale factors are associated). Accordingly, rather than using a context reset flag, the scale factor grouping side information may be exploited to determine when to reset the context of the arithmetic decoding.

Figure 13:
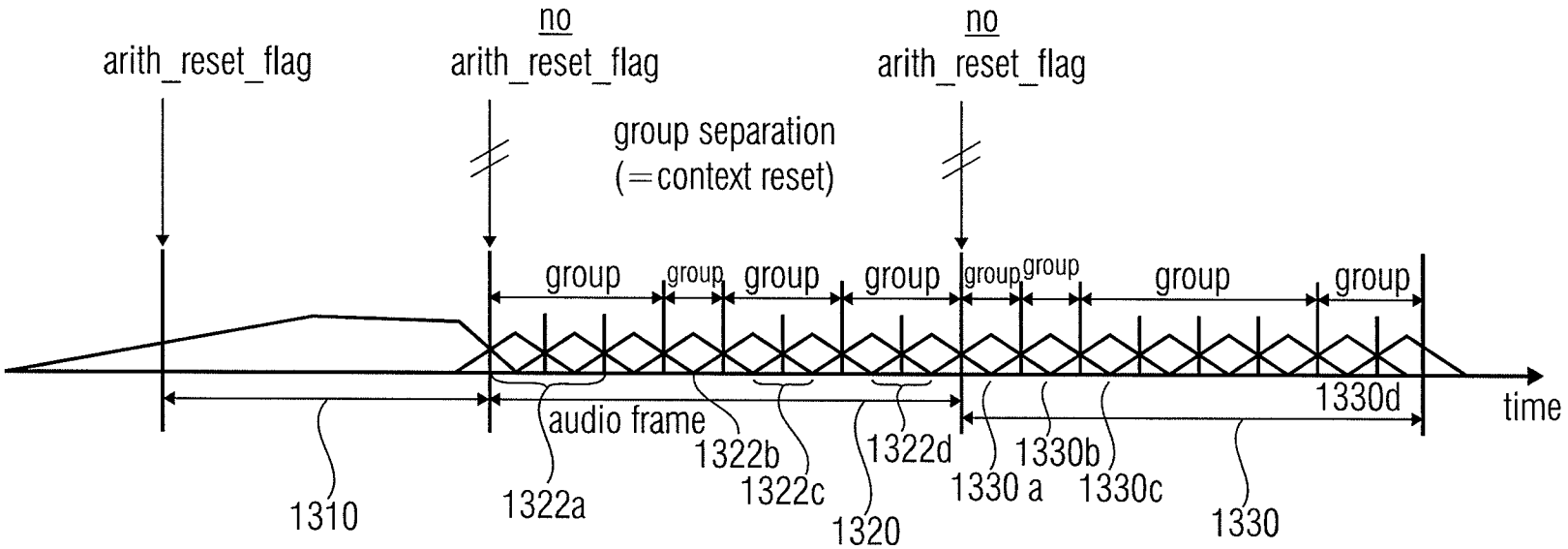
FIG. 13 shows a graphical representation of a context reset based on grouping-information.

In the following, an example of this concept will be explained taking reference to FIG. 13, which shows a graphical representation of a sequence of audio frames and the respective side information. FIG. 13 shows a first audio frame 1310, a second audio frame 1320 and a third audio frame 1330. The first audio frame 1310 may be a "long window" audio frame within the meaning of ISO/IEC 14493-3, part 3, subpart 4 (for example of type "LONG_START_WINDOW"). A context reset flag may be associated with the audio frame 1310 to decide whether the context for an arithmetic decoding of spectral values of the audio frame 1310 should be reset, which context reset flag would be considered accordingly by the audio decoder.

In contrast, the second audio frame is of type "EIGHT_SHORT_SEQUENCE" and may accordingly comprise eight sets of encoded spectral values. However, the first three sets of encoded spectral values may be grouped together to form one group (to which a common scale factor information is associated) 1322*a*. Another group 1322*b* may be defined by a single set of spectral values. A third group 1322C may comprise two sets of spectral values associated therewith, and a fourth group 1322D may comprise another two sets of spectral values associated therewith. The grouping of sets of spectral values of the audio frame 1320 may be signaled by the so-called "scale_factor_grouping" bits defined, for example, in table 4.6 of the above-referenced standard. Similarly, the audio frame 1340 may comprise four groups 1330A, 1330B, 1330C, 1330D.

However, the audio frames 1320, 1330 may, for example, not comprise a dedicated context reset flag. For entropy decoding the spectral values of the audio frame 1320, the decoder may, for example unconditionally or in dependence on a context reset flag, reset the context before decoding the first set of spectral coefficients of the first group 1322A. Subsequently, the audio decoder may avoid resetting the context between the decoding of different sets of the spectral coefficients of the same group of the spectral coefficients. However, whenever the audio decoder detects the beginning of a new group within the audio frame 1320 comprising a plurality of groups (of sets of spectral coefficients), the audio decoder may reset the context for the entropy decoding of the spectral coefficients. Thus, the audio encoder may effectively reset the contexts for decoding of the spectral coefficients of the first group 1322A, before the decoding of the spectral coefficients of the second group 1322B, before the decoding of the spectral coefficients of the third group 1322C, and before the decoding of the spectral coefficients of the fourth group 1322D.

Accordingly, a separate transmission of a dedicated context reset flag may be avoided within such audio frames in which there are a plurality of sets of spectral coefficients. Accordingly, the extra bit load produced by the transmission of the grouping bits may at least partly be compensated by the omission of the transmission of a dedicated context reset flag in such a frame, which may be unnecessary in some applications.

To summarize, a reset strategy has been described which can be implemented as a decoder feature (and also as an encoder feature). The strategy described here does not need the transmission of any additional information (like a dedicated side information for resetting the context) to a decoder. It uses the side information already sent by the decoder (e.g. by an encoder providing an AAC encoded audio stream corresponding to the above industry standard). As it is described herein, the change of content within the signal (audio signal) can happen from frame to frame of, for example, 1024 samples. In this case, we have already the reset flag which can control the context-adaptive coding and mitigate the impact on its performance. However, within a frame of 1024 samples, the content can change as well. In such a case, when an audio coder (for example according to the unified speech and audio coding "USAC") uses a frequency domain (FD) coding, the decoder will usually switch to short blocks. In short blocks, grouping information is sent (as discussed above) which already gives information about the position of a transition or a transient (of the audio signal). Such information can be reused for resetting the context, as discussed in this section.

On the other hand, when an audio coder (like, for example, according to the unified speech and audio coding "USAC") uses linear prediction domain (LPD) coding, a change of content will affect the selected coding modes. When different transform-coding-excitations occur within one frame of 1024 samples, a context mapping may be used, as described above. (See, for example, the context mapping of FIG. 9D). It was found to be a better solution than to reset the context every time a different transform-coded excitation is selected. As the linear-prediction-domain coding is very adaptive, the coding mode changes constantly and a systematic reset will penalize greatly the coding performance. However, when an ACELP is selected, it will be advantageous to reset the context for the next transform coded excitation (TCX). The selection of ACELP between transform coded excitations is a strong indication that a great change in the signal happened.

In other words, taking reference, for example, to FIG. 12, the context reset flag preceding the first TCX "block" of an audio frame when using a linear prediction main coding may be omitted, however, totally or selectively, if there is at least one ACELP-coded stimulus within the audio frame. The decoder may, in this case, be configured to reset the context if a first TCX "block" following an ACELP "block" is identified, and to omit a reset of the context between a decoding of spectral values of subsequent TCX "blocks".

Also, optionally, the decoder may be configured to evaluate a context reset flag, for example once per audio frame, if a TCX block is preceding the parent audio frame, to allow for a reset of the context even in the presence of an extended segments of TCX "blocks".

2. Audio Encoder 2.1. Audio Encoder—Basic Concepts

In the following, the basic concept of a context-based entropy encoder will be discussed in order to facilitate the understanding of the specific procedures for the reset of the context which will be discussed in detail in the following.

Noiseless coding can be based on quantized spectral values and may use context dependent cumulative frequency tables derived from, for example, four previously decoded neighbouring tuples. FIG. 7 illustrates another embodiment. FIG. 7 shows a time frequency plane, wherein along the time axis three time slots are indexed n, n−1 and n−2. Furthermore, FIG. 7 illustrates four frequency or spectral bands which are labelled by m−2, m−1, m and m+1. FIG. 7 shows within each time-frequency slot boxes, which represent tuples of samples to be encoded or decoded. Three different types of tuples are illustrated in FIG. 7, in which round boxes having a dashed or dotted border indicate remaining tuples to be encoded or decoded, rectangular boxes having a dotted border indicate previously encoded or decoded tuples and grey boxes with a solid border indicate previously en/decoded tuples, which are used to determine the context for the current tuple to be encoded or decoded.

Note that the previous and current segments referred to in the above described embodiments may correspond to a tuple in the present embodiment, in other words, the segments may be processed band wise in the frequency or spectral domain. As illustrated in FIG. 76, tuples or segments in the neighbourhood of a current tuple (i.e. in the time and the frequency or spectral domain) may be taken into account for deriving a context. Cumulative frequency tables may then be used by the arithmetic coder to generate a variable length binary code. The arithmetic coder may produce a binary code for a given set of symbols and their respective probabilities. The binary code may be generated by mapping a probability interval, where the set of symbols lies, to a codeword.

In the present embodiment context based arithmetic coding may be carried out on the basis of 4-tuples (i.e. on four spectral coefficient indices), which are also labelled q(n,m), or q[m][n], representing the spectral coefficients after quantization, which are neighboured in the frequency or spectral domain and which are entropy coded in one step. According to the above description, coding may be carried out based on the coding context. As indicated in FIG. 7, additionally to the 4-tuple, which is coded (i.e. the current segment) four previously coded 4-tuples are taken into account in order to derive the context. These four 4-tuples determine the context and are previous in the frequency and/or previous in the time domain.

Figure 21:
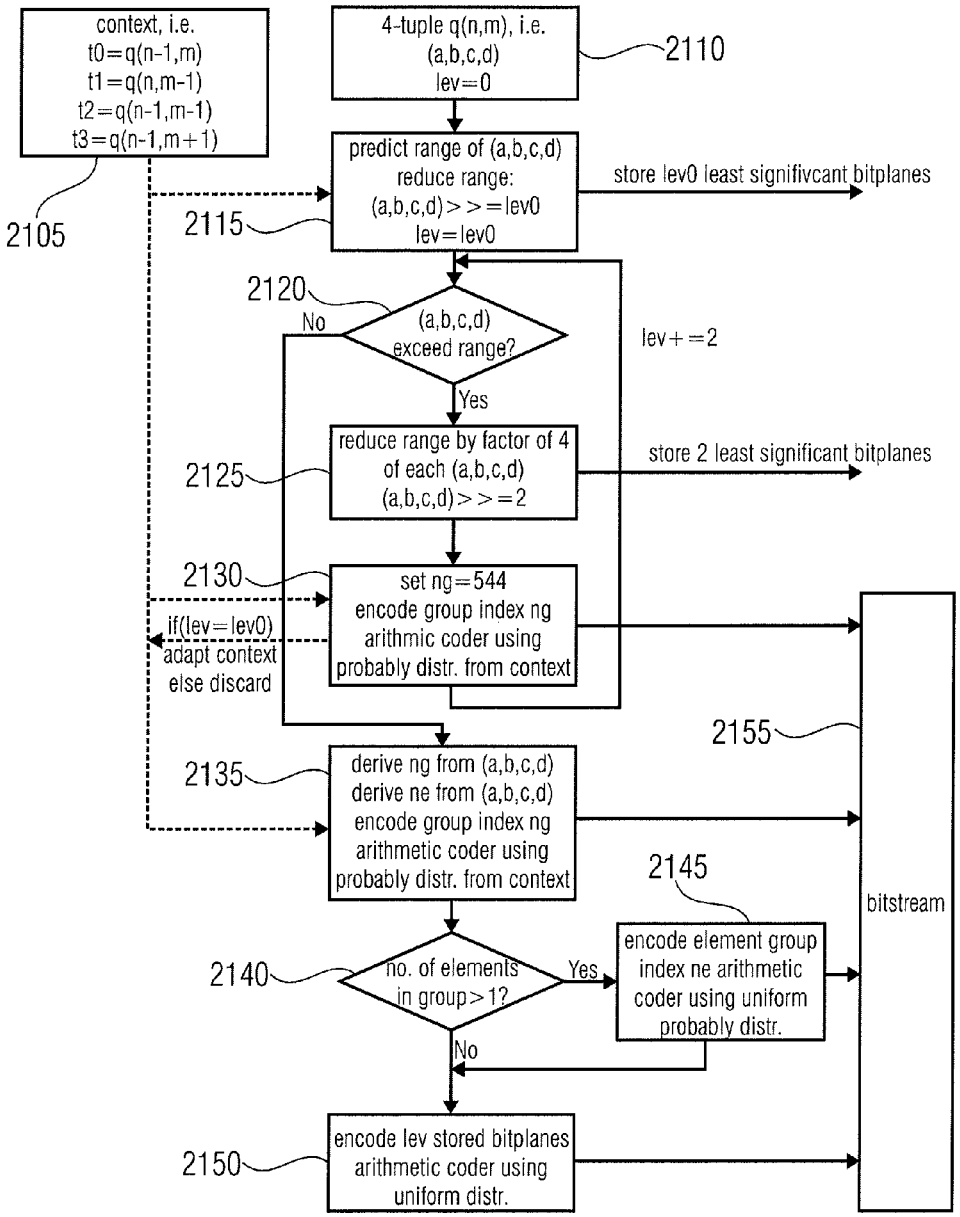
FIG. 21 shows a flow chart of a method for a context-dependent arithmetic encoding of tuples of spectral values, which can be used in the inventive audio encoders.

FIG. 21*a* shows a flow-chart of a USAC (USAC=Universal Speech and Audio Coder) context dependent arithmetic coder for the encoding scheme of spectral coefficients. The encoding process depends on the current 4-tuple plus the context, where the context is used for selecting the probability distribution of the arithmetic coder and for predicting the amplitude of the spectral coefficients. In FIG. 21*a* the box 2105 represents context determination, which is based on t0, t1, t2 and t3 corresponding to q(n−1, m), q(n,m−1), q (n−1,m−1) and q (n−1,m+1).

Generally, in embodiments the entropy encoder can be adapted for encoding the current segment in units of a 4-tuple of spectral coefficients and for predicting an amplitude range of the 4-tuple based on the coding context.

In the present embodiment the encoding scheme comprises several stages. First, the literal codeword is encoded using an arithmetic coder and a specific probability distribution. The codeword represents four neighbouring spectral coefficients (a,b,c,d), however, each of a, b, c, d is limited in range:

$$-5<a,b,c,d<4.$$

Generally, in embodiments the entropy encoder can be adapted for dividing the 4-tuple by a predetermined factor as often as is useful to fit a result of the division in the predicted range or in a predetermined range and for encoding a number of divisions useful, a division remainder and the result of the division when the 4-tuple does not lie in the predicted range, and for encoding a division remainder and the result of the division otherwise.

In the following, if the term (a,b,c,d), i.e. any coefficient a, b, c, d, exceeds the given range in this embodiment, this can in general be considered by dividing (a,b,c,d) as often by a factor (e.g. 2 or 4) as is useful, for fitting the resulting codeword in the given range. The division by a factor of 2 corresponds to a binary shifting to the right-hand side, i.e. (a,b,c, d)>>1. This diminution is done in an integer representation, i.e. information may be lost. The least significant bits, which may get lost by the shifting to the right, are stored and later on coded using the arithmetic coder and a uniform probability distribution. The process of shifting to the right is carried out for all four spectral coefficients (a,b,c,d).

In general embodiments, the entropy encoder can be adapted for encoding the result of the division or the 4-tuple using a group index ng, the group index ng referring to a group of one or more code words for which a probability distribution is based on the coding context, and an element index ne in case the group comprises more than one codeword, the element index ne referring to a codeword within the group and the element index can be assumed uniformly distributed, and for encoding the number of divisions by a number of escape symbols, an escape symbol being a specific group index ng only used for indicating a division and for encoding the remainders of the divisions based on a uniform distribution using an arithmetic coding rule. The entropy encoder can be adapted for encoding a sequence of symbols into the encoded audio stream using a symbol alphabet comprising the escape symbol, and group symbols corresponding to a set of available group indices, a symbol alphabet comprising the corresponding element indices, and a symbol alphabet comprising the different values of the remainders.

In the embodiment of FIG. 21*a*, the probability distribution for encoding the literal codeword and also an estimation of the number of range-reduction steps can be derived from the context. For example, all code words, in a total $8^4$=4096, span in total 544 groups, which consist of one or more elements. The codeword can be represented in the bitstream as the group index ng and the group element ne. Both values can be coded using the arithmetic coder, using certain probability distributions. In one embodiment the probability distribution for ng may be derived from the context, whereas the probability distribution for ne may be assumed to be uniform. A combination of ng and ne may unambiguously identify a codeword. The remainder of the division, i.e. the bit-planes shifted out, may be assumed to be uniformly distributed as well.

In FIG. 21*a*, in step 2110, the 4-tuple q(n,m), that is (a,b, c,d) or the current segment is provided and a parameter lev is initiated by setting it to 0. In step 2115 from the context, the range of (a,b,c,d) is estimated. According to this estimation, (a,b,c,d) may be reduced by lev0 levels, i.e. divided by a factor of $2^{lev0}$. The lev0 least significant bitplanes are stored for later usage in step 2150.

In step 2120 it is checked whether (a,b,c,d) exceeds the given range and if so, the range of (a,b,c,d) is reduced by a factor of 4 in step 2125. In other words, in step 2125 (a,b,c,d) are shifted by 2 to the right and the removed bitplanes are stored for later usage in step 2150.

In order to indicate this reduction step, ng is set to 544 in step 2130, i.e. ng=544 serves as an escape codeword. This codeword is then written to the bitstream in step 2155, where for deriving the codeword in step 2130 an arithmetic coder with a probability distribution derived from the context is used. In case this reduction step was applied the first time, i.e. if lev==lev0, the context is slightly adapted. In case the reduction step is applied more than once, the context is discarded and a default distribution is used further on. The process then continues with step 2120.

If in step 2120 a match for the range is detected, more specifically if (a,b,c,d) matches the range condition, (a,b,c,d) is mapped to a group ng, and, if applicable, the group element index ne. This mapping is unambiguously, that is (a,b,c,d) can be derived from ng and ne. The group index ng is then coded by the arithmetic coder, using a probability distribution arrived for the adapted/discarded context in step 2135. The group index ng is then inserted into the bitstream in step 2155. In a following step 2140, it is checked whether the number of elements in the group is larger than 1. If it is useful, that is if the group indexed by ng consists of more than one element, the group element index ne is coded by the arithmetic coder in step 2145, assuming a uniform probability distribution in the present embodiment.

Following step 2145, the element group index ne is inserted into the bitstream in step 2155. Finally, in step 2150, all stored bitplanes are coded using the arithmetic coder, assuming a uniform probability distribution. The coded stored bitplanes are then also inserted into the bitstream in step 2155.

To summarize the above, an entropy encoder, in which the context reset concepts described in the following can be used, receives one or more spectral values and provides a code word, typically of variable length, on the basis of the one or more received spectral values. The mapping of the received spectral values onto the code word is dependent on an estimated probability distribution of code words, such that, generally speaking, short code words are associated with spectral values (or combinations thereof) having a high probability and such that long code words are associated with spectral values (or combinations thereof) having a low probability. The context is taken into consideration in that it is assumed that the probability of the spectral values (or combinations thereof) is dependent on previously encoded spectral values (or combinations thereof). Accordingly, the mapping rule (also designated "mapping information" or "codebook" or "cumulative frequencies table") is selected in dependence on the context, i.e. on the previously encoded spectral values (or combinations thereof). However, the context is not always considered. Rather, the context is sometimes reset by the "context reset" functionality described herein. By resetting the context, it can be considered that the spectral values (or combinations thereof) to be currently encoded differ strongly from what would be expected on the basis of the context.

Figure 14:
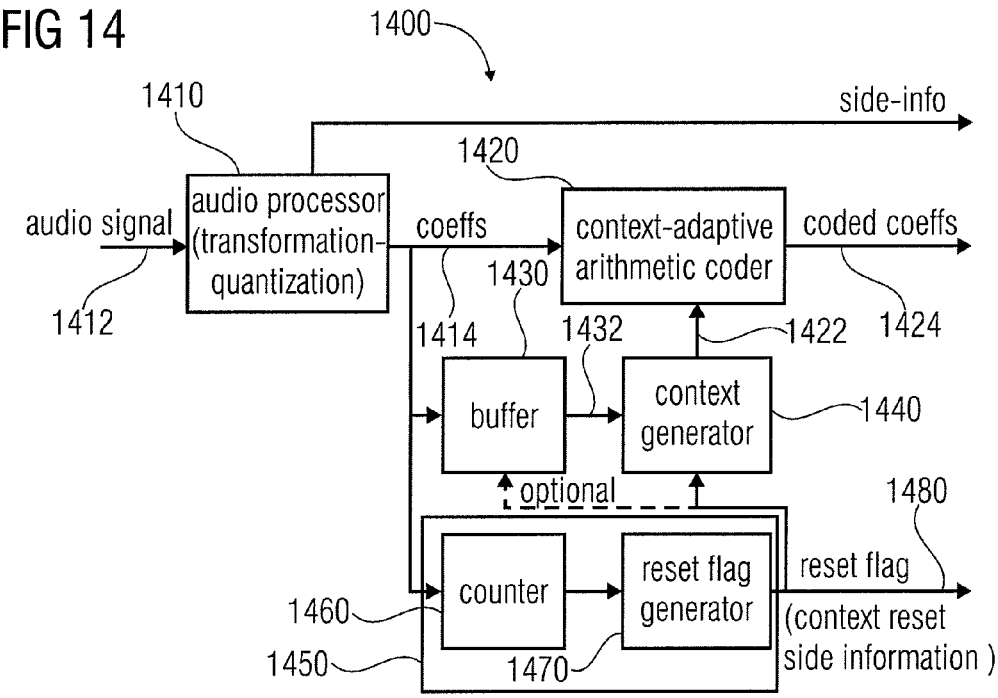
FIG. 14 shows a block schematic diagram of an audio encoder, according to an embodiment of the invention.

2.2 Audio Encoder-Embodiment of FIG. 14

In the following, an audio encoder will be described taking reference to FIG. 14, which is based on the basic concepts described before. The audio encoder 1400 in FIG. 14 comprises an audio processor 1410, which is configured to receive an audio signal 1412 and to perform an audio processing, for example, a transformation of the audio signal 1410 from the time domain to the frequency domain, and a quantization of the spectral values obtained by the time-domain to frequency-domain transformation. Accordingly, the audio processor provides quantized spectral coefficients (also designated as spectral values) 1414. The audio encoder 1400 also comprises a context-adaptive arithmetic coder 1420, which is configured to receive the spectral coefficients 1414 and the context information 1422, which context information 1422 can be used for selecting mapping rules for mapping spectral values (or combinations thereof) onto code words, which are an encoded representation of these spectral values (or combinations thereof). Accordingly, the context-adaptive arithmetic coder 1420 provides encoded spectral values (encoded coefficients) 1424. The encoder 1400 also comprises a buffer 1430 for buffering previously encoded spectral values 1414, because the previously encoded spectral values 1432 provided by the buffer 1430 have an impact on the context. The encoder 1400 also comprises a context generator 1440, which is configured to receive the buffered, previously encoded coefficients 1432 and to derive the context information 1422 (for example a value "PKI" for selecting a cumulative frequencies table or a mapping information for the context-adaptive arithmetic coder 1420) on the basis thereof. However, the audio encoder 1400 also comprises a reset mechanism 1450 for resetting the context. The resetting mechanism 1450 is configured to determine when to reset the context (or context information) provided by the context generator 1440. The reset mechanism 1450 may optionally act on the buffer 1430, to reset the coefficients stored in or provided by the buffer 1430, or on the context generator 1440, to reset the context information provided by the context generator 1440.

The audio encoder 1400 of FIG. 14 comprises a reset strategy as an encoder feature. The reset strategy triggers at the encoder side a "reset flag", which can be considered as a context reset side information, which is sent every frame of 1024 samples (time domain samples of the audio signal) on one bit. The audio encoder 1400 comprises a "regular reset" strategy. According to this strategy, the reset flag is regularly activated, thereby resetting the context used in the encoder and also the context in an appropriate decoder (which processes the context reset flag as described above).

The advantage of such a regular reset is to limit the dependence of the coding of the present frame from the previous frames. Resetting the context every n-frames (which is achieved by the counter 1460 and the reset flag generator 1470) allows the decoder to resynchronize its states with the encoder even when an error of transmission occurs. The decoded signal can then be recovered after a reset point. Further, the "regular reset" strategy allows the decoder to randomly access at any reset points of the bitstream without considering the past information. The interval between the reset points and the coding performance is a trade-off, which is made at the encoder according to the targeted receiver and the transmission channel characteristics.

Figure 15:
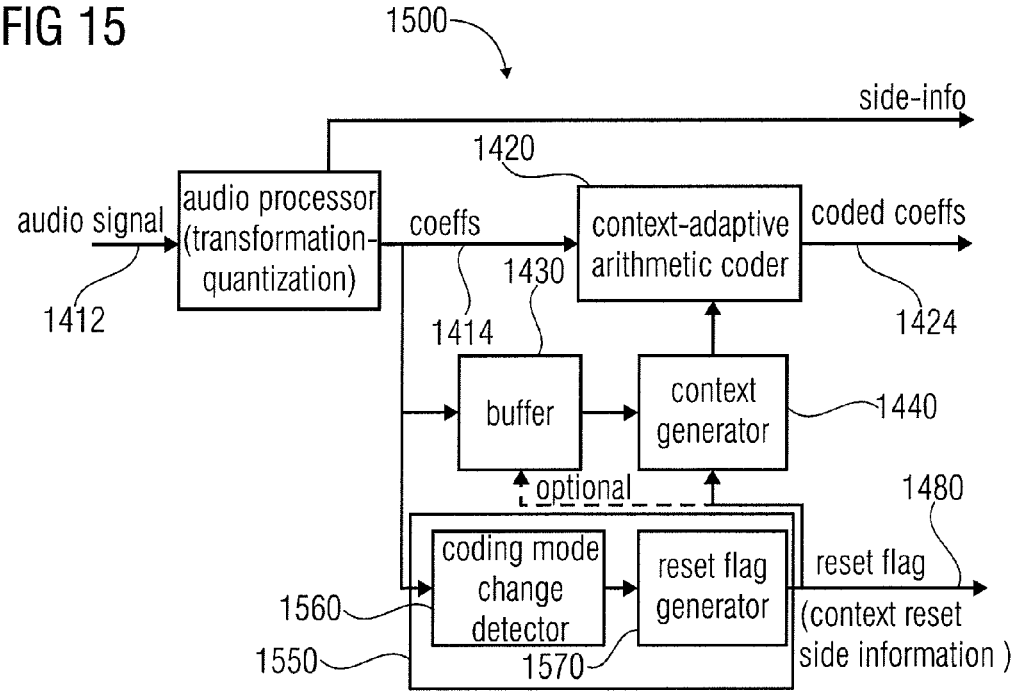
FIG. 15 shows a block schematic diagram of an audio encoder, according to another embodiment of the invention.

2.3 Audio Encoder—Embodiment of FIG. 15

In the following, another reset strategy as an encoder feature will be described. The following strategy triggers at the encoder side the reset flag which is sent every frame of 1024 samples on 1-bit. In the embodiment of FIG. 15, the reset is triggered by the coding characteristics.

As can be seen in FIG. 15, the audio encoder 1500 is very similar to the audio encoder 1400, such that identical means and signals are designated with identical reference numerals and will not be explained again. However, the audio encoder comprises a different reset mechanism 1550. The context reset mechanism 1550 comprises a coding mode change detector 1560 and a reset flag generator. The coding mode change detector detects a change in the coding mode and instructs the reset flag generator 1570 to provide the (context) reset flag. The context reset flag also acts on the context generator 1440, or alternatively or in addition, on the buffer 1430 to reset the context. As mentioned above, the reset is trigged by the coding characteristics. In a switched coder, like the unified speech and audio coder (USAC), different coding modes can happen and be successive. The context is then difficult to deduce because the time/frequency resolution of the present frame can differ from the resolution of the previous ones. It is the reason why it exists in USAC a context mapping mechanism which permits to recover a context even when the resolution changes between two frames. However, some coding modes differ so much from each other that even a context mapping may not be efficient. A reset may then be used.

For example, in a unified speech and audio coder (USAC) such a reset may be triggered when going from/to frequency domain coding to/from linear-prediction-domain coding. In other words, a context reset of the context-adaptive arithmetic coder 1420 may be performed and signalled whenever the coding mode changes between frequency domain coding and linear prediction domain coding. Such a reset of the context may be signalised or not by a dedicated context reset flag. However, alternatively, a different side information, for example side information indicating the coding mode, may be exploited at the decoder side to trigger the reset of the context.

2.4. Audio Encoder—Embodiment of FIG. 16

Figure 16:
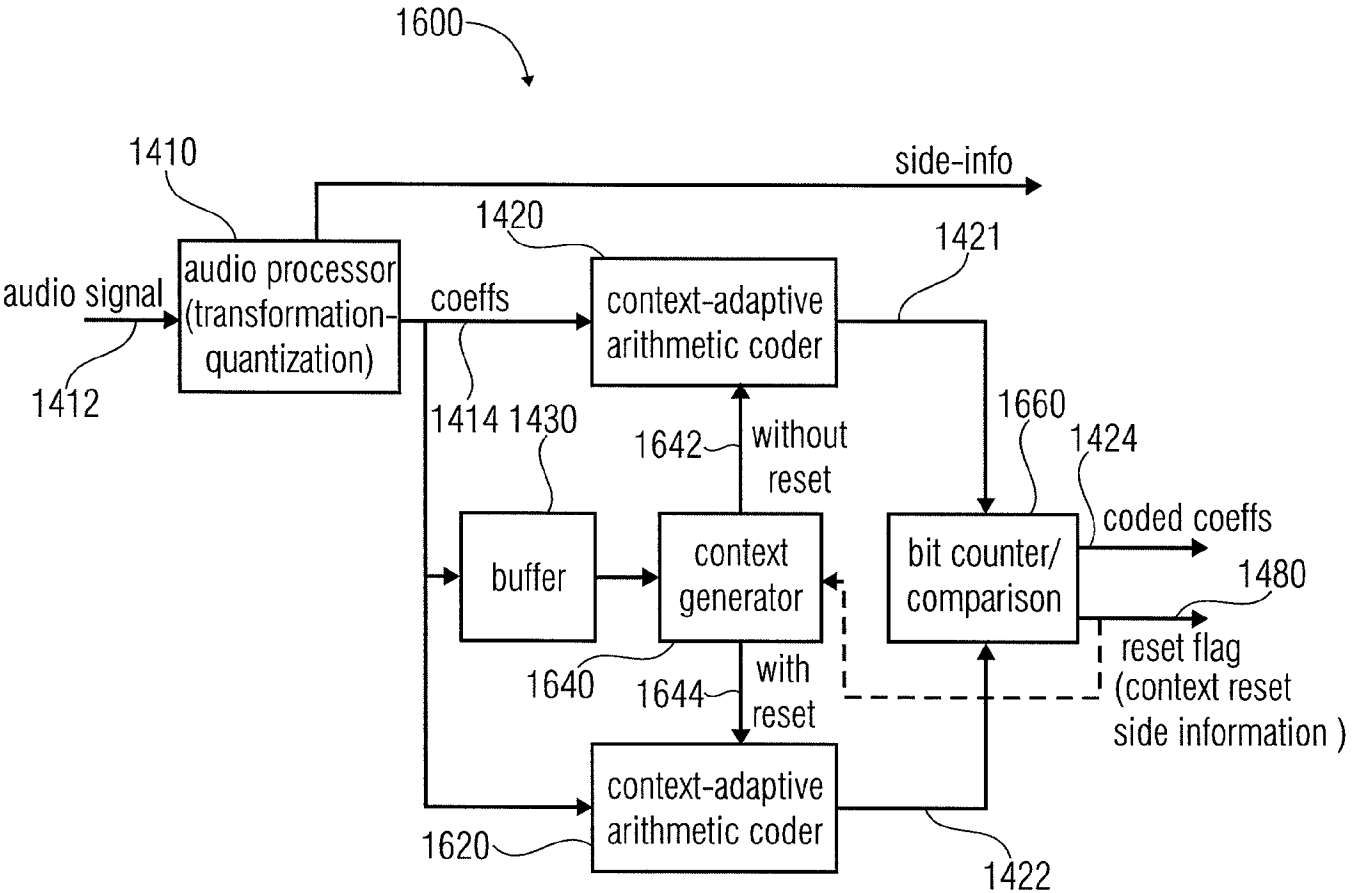
FIG. 16 shows a block schematic diagram of an audio encoder, according to another embodiment of the invention.

FIG. 16 shows a block schematic diagram of another audio encoder, which implements yet another reset strategy as an encoder feature. The strategy triggers at the encoder side the reset flag which is sent every frame of 1024 samples on 1 bit.

The audio encoder 1600 of FIG. 16 is similar to the audio encoders 1400, 1500 of FIGS. 14 and 15, such that identical features and signals are designated with identical reference numerals. However, the audio encoder 1600 comprises two context-adaptive arithmetic coders 1420, 1620 (or is at least capable of encoding the spectral values 1414 to be currently encoded using two different encoding contexts). For this purpose, an advanced context generator 1640 in configured to provide context information 1642, which is obtained without a reset of the context, for the first context-adaptive arithmetic encoding (for example in the context-adaptive arithmetic encoder 1420), and to provide a second context information 1644, which is obtained by applying a reset of the context, for a second encoding of the spectral values to be currently encoded (for example in the context-adaptive arithmetic encoder 1620). A bit counter/comparison 1660 determines (or estimates) the number of bits that may be used for the encoding of the spectral value using a non-reset context and also determines (or estimates) the number of bits that may be used for encoding the spectral values to be currently encoded using a reset context. Accordingly, the bit counter/comparison 1660 decides whether it is more advantageous, in terms of bitrate, to reset the context or not. Accordingly, the bit counter/comparison 1660 provides an active context reset flag in dependence on whether it is advantageous, in terms of bitrate, to reset the context or not. Further, the bit counter/comparison 1660 selectively provides the spectral values encoded using a non-reset context or the spectral values encoded using a reset context as an output information 1424, again in dependence on whether a non-reset context or a reset context results in a lower bitrate.

To summarize the above, FIG. 16 shows an audio encoder which uses a closed-loop decision to decide whether to activate or not to activate the reset flag. Thus, the decoder comprises a reset strategy as an encoder feature. The strategy triggers at the encoder side the reset flag, which is sent every frame of 1024 samples on one bit.

It has been found that sometimes the characteristics of a signal change abruptly from frame to frame. For such non-stationary parts of the signal, the context from the past frame is often meaningless. Furthermore, it has been found that it can be more penalizing than beneficial to take into account the past frames in the context adaptive coding. A solution is then to trigger the reset flag when it happens. A way to detect such a case is to compare the decoding efficiency when both the reset flag is on and off. The flag value corresponding to the best coding is then used (to determine the new state of the encoder context) and transmitted. This mechanism was implemented in the unified speech and audio coding (USAC), and the following average gain of performance was measured:

12 kbps mono: 1.55 bit/frame (max: 54)
16 kbps mono: 1.97 bit/frame (max: 57)
20 kbps mono: 2.85 bit/frame (max: 69)
24 kbps mono: 3.25 bit/frame (max: 122)
16 kbps stereo: 2.27 bit/frame (max: 70)
20 kbps stereo: 2.92 bit/frame (max: 80)
24 kbps stereo: 2.88 bit/frame (max: 119)
32 kbps stereo: 3.01 bit/frame (max: 121)

2.5. Audio Encoder—Embodiment of FIG. 17

Figure 17:
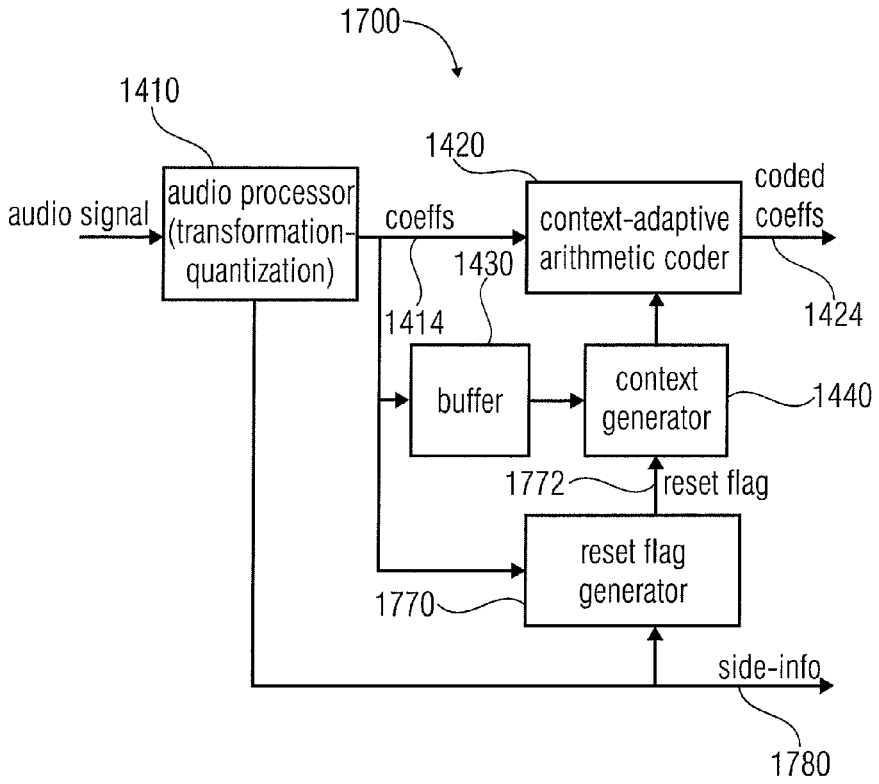
FIG. 17 shows a block schematic diagram of an audio encoder, according to yet another embodiment of the invention.

In the following, another audio encoder 1700 will be described taking reference to FIG. 17. The audio encoder 1700 is similar to the audio encoders 1400, 1500, and 1600 of FIGS. 14, 15 and 16, such that identical reference numerals will be used to designate identical means and signals.

However, the audio encoder 1700 comprises a different reset flag generator 1770, when compared to the other audio encoders. The reset flag generator 1770 receive a side information, which is provided by the audio processor 1410 and provides, on the basis thereof, the reset flag 1772, which is provided to the context generator 1440. However, it should be noted that the audio encoder 1700 avoids to include the reset flag 1772 into the encoded audio stream. Rather, only the audio processor side information 1780 is included into the encoded audio stream.

The reset flag generator 1770 may, for example, be configured to derive the context reset flag 1772 from the audio processor side information 1780. For example, the reset flag generator 1770 may evaluate a grouping information (already described above) to decide whether to reset the context. Thus, the context may be reset between an encoding of different groups of sets of spectral coefficients, as explained, for example, for the decoder taking reference to FIG. 13.

Accordingly, the encoder 1700 uses a reset strategy, which may be identical to a reset strategy at a decoder. However, the reset strategy may avoid the transmission of a dedicated context reset flag. In other words, the reset strategy described here does not need the transmission of any additional information to the decoder. It uses the side information which is already sent to the decoder (for example, a grouping side information). It should be noted here that for the present strategy, identical mechanisms for determining whether to reset the context or not are used at the encoder and at the decoder. Accordingly, reference is made to the discussion with respect to FIG. 13.

2.6. Audio Encoder—Further Remarks

First of all, it should be noted that different reset strategies discussed herein, for example, in section 2.1. to 2.5, can be combined. In particular, the reset strategies as an encoder feature, which have been discussed with reference to FIGS. 14-16 can be combined. However, the reset strategy discussed with reference FIG. 17 can also be combined with the other reset strategies, if desired.

In addition, it should be noted that the reset of the context at the encoder side should occur synchronously with the reset of the context at the decoder side. Accordingly, the encoder is configured to provide the context reset flag discussed above at the time (or for the frames, or windows) discussed above (e.g. with reference to FIGS. 10*a*-10*c*, 12 and 13), such that the discussion of the decoder implies a corresponding functionality of the encoder (regarding the generation of the context reset flag). Similarly, the discussion of the functionality of encoder corresponds to the respective functionality of the decoder in most cases.

3. Method for Decoding an Audio Information

Figure 18:
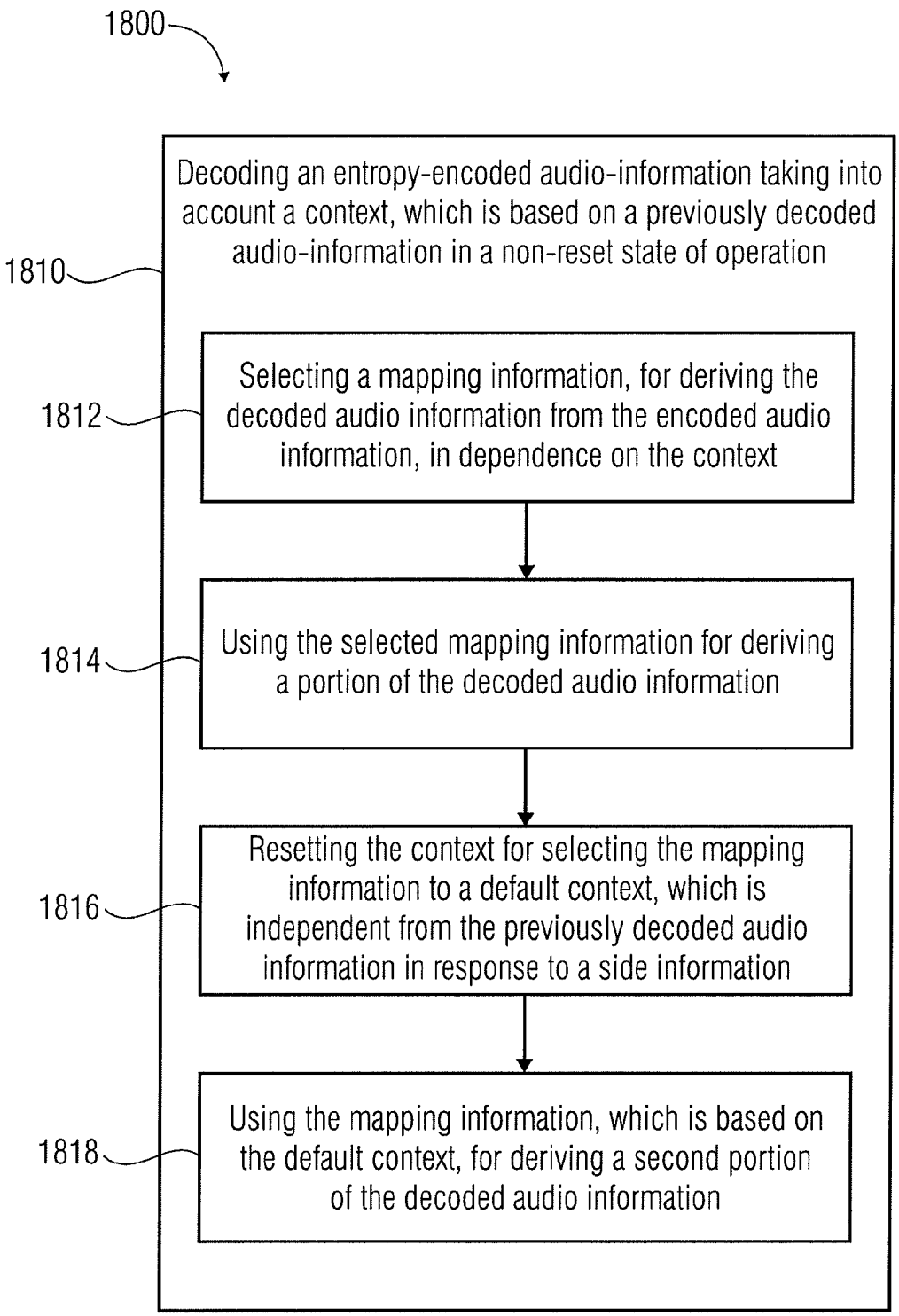
FIG. 18 shows a flow chart of a method for providing a decoded audio information, according to an embodiment of the invention.

In the following, a method for providing a decoded audio information on the basis of encoded audio information will be briefly discussed taking reference to FIG. 18. FIG. 18 shows such a method 1800. The method 1800 comprises a step 1810 of decoding the entropy-encoded audio information taking into account a context, which is based on a previously decoded audio information, in a non-reset state of operation. Decoding the entropy-encoded audio information comprises selecting 1812 a mapping information for deriving the decoded audio information from the encoded audio information in dependence on the context and using 1814 the selected mapping information for deriving a portion of the decoded audio information. Decoding the entropy-encoded audio information also comprises resetting 1816 the context for selecting the mapping information to a default context, which is independent from the previously decoded audio information, in response to a side information, and using 1818 the mapping information, which is based on the default context, for deriving a second portion of the decoded audio information.

The method 1800 can be supplemented by any of the functionalities discussed herein regarding the decoding of an audio information, also regarding the inventive apparatus.

4. Method for Encoding an Audio Signal

Figure 19:
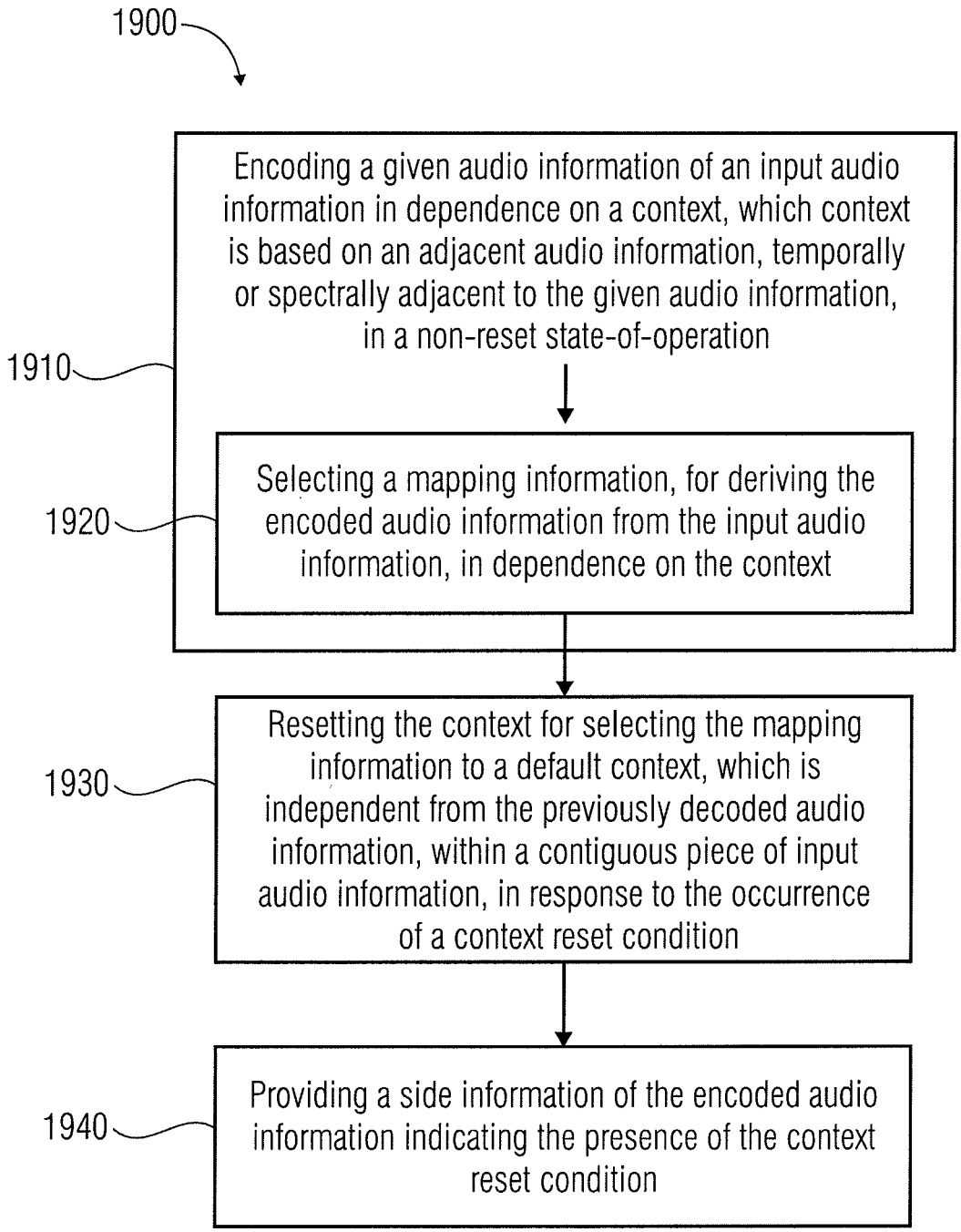
FIG. 19 shows a flow chart of a method for providing an encoded audio information, according to an embodiment of the invention.

In the following, a method 1900 for providing an encoded audio information on the basis of an input audio information will be described taking reference to FIG. 19.

The method 1900 comprises encoding 1910 a given audio information of the input audio information in dependence on a context, which context is based on an adjacent audio information, temporally or spectrally adjacent to the given audio information, in a non-reset state of operation.

The method 1900 also comprises selecting 1920 a mapping information, for deriving the encoded audio information from the input audio information, in dependence on the context.

Also, the method 1900 comprises resetting 1930 the context for selecting the mapping information to a default context, which is independent from the previously decoded audio information, within a contiguous piece of input audio information (e.g. between decoding two frames, the time domain signals of which are overlapped-and-added) in response to the occurrence of a context reset condition.

The method 1900 also comprises providing 1940 a side information (e.g. a context reset flag, or a grouping information) of the encoded audio information indicating the presence of such a context reset condition.

The method 1900 can be supplemented by any of the features and functionalities described herein with respect to the inventive audio encoding concept.

5. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio decoder for providing a decoded audio information on the basis of an entropy encoded audio information, the audio decoder comprising:

a context-based entropy decoder configured to decode the entropy-encoded audio information in dependence on a context, which context is based on a previously-decoded audio information in a non-reset state-of-operation;

wherein the context-based entropy decoder is configured to select a mapping information, for deriving the decoded audio information from the encoded audio information, in dependence on the context; and wherein the context-based entropy decoder comprises a context resetter configured to reset the context for selecting the mapping information to a default context, which default context is independent from the previously-decoded audio information, in response to a side information of the encoded audio information.

2. The audio decoder according to claim 1, wherein the context resetter is configured to selectively reset the context-based entropy decoder between a decoding of subsequent time portions of the encoded audio information comprising associated spectral data of the same spectral resolution.

3. The audio decoder according to claim 1, wherein the audio decoder is configured to receive, as a component of the encoded audio information, an information describing spectral values in a first audio frame and in a second audio frame subsequent to the first audio frame;

wherein the audio decoder comprises a spectral-domain-to-time-domain transformer configured to overlap-and-add a first windowed time domain signal, which is based on the spectral values of the first audio frame, and a second windowed time domain signal, which is based on the spectral values of the second audio frame, to derive the decoded audio information;

wherein the audio decoder is configured to separately adjust window shapes of a window for acquiring the first windowed time domain signal and of a window for acquiring a second windowed time domain signal; and wherein the audio decoder is configured to perform, in response to the side information, a reset of the context between a decoding of the spectral values of the first audio frame and a decoding of the spectral values of the second audio frame, even if the second window shape is identical to the first window shape, such that the context used for decoding the encoded audio information of the second audio frame is independent from the decoded audio information of the first audio frame if the side information indicates to reset the context.

4. The audio decoder according to claim 3, wherein the audio decoder is configured to receive a context-reset side information for signaling a reset of the context; and wherein the audio decoder is configured to additionally receive a window-shape side information; and wherein the audio decoder is configured to adjust the window shapes of windows for acquiring the first and second windowed time domain signals independent from performing the reset of the context.

5. The audio decoder according to claim 1, wherein the audio decoder is configured to receive, as the side information for resetting the context, a one-bit context reset flag per audio frame of the encoded audio information; and wherein the audio decoder is configured to receive, in addition to the context reset flag, a side information describing a spectral resolution of spectral values represented by the encoded audio information or a window length of a time window for windowing time domain values represented by the encoded audio information; and wherein the context resetter is configured to perform a reset of the context, in response to the one-bit context-reset flag, between a decoding of spectral values of two audio frames of the encoded audio information representing spectral values of identical spectral resolutions or window lengths.

6. The audio decoder according to claim 1, wherein the audio decoder is configured to receive, as the side information for resetting the context, a one-bit context reset flag per audio frame of the encoded audio information;

wherein the audio decoder is configured to receive an encoded audio information comprising a plurality of sets of spectral values per audio frame;

wherein the context-based entropy decoder is configured to decode the entropy-encoded audio information of a subsequent set of spectral values of a given audio frame in dependence on a context, which context is based on a previously-decoded audio information of a preceding set of spectral values of the given audio frame, in a non-reset state of operation; and wherein the context resetter is configured to reset the context to the default context before a decoding of a first set of spectral values of the given audio frame and between a decoding of any two subsequent sets of spectral values of the given audio frame in response to the one-bit context reset flag, such that an activation of the one-bit context reset flag of the given audio frame causes a multiple-time resetting of the context when decoding the multiple sets of spectral values of the audio frame.

7. The audio decoder according to claim 6, wherein the audio decoder is configured to also receive a grouping side information; and wherein the audio decoder is configured to group two or more of the sets of spectral values for a combination with a common scale factor information in dependence on the grouping side information; and wherein the context resetter is configured to reset the context to the default context between a decoding of two sets of spectral values grouped together in response to the one-bit context-reset flag.

8. The audio decoder according to claim 1, wherein the audio decoder is configured to receive, as the side information for resetting the context, a one-bit context reset flag per audio frame;

when the audio decoder is configured to receive, as the encoded audio information, a sequence of encoded audio frames, the sequence of encoded audio frames comprising single-window frames and multi-window frames;

wherein the entropy decoder is configured to decode entropy-encoded spectral values of a multi-window audio frame following a previous single-window audio frame in dependence on a context, which context is based on a previously-decoded audio information of the previous single window audio frame in a non-reset state of operation;

wherein the entropy decoder is configured to decode entropy-encoded spectral values of a single-window audio frame following a previous multi-window audio frame in dependence on a context, which context is based on a previously-decoded audio information of the previous multi-window audio frame in a non-reset state of operation;

wherein the entropy decoder is configured to decode entropy-encoded spectral values of a single-window audio frame following a previous single-window audio frame in dependence on a context, which context is based on a previously-decoded audio information of the previous single-window audio frame in a non-reset state of operation;

wherein the entropy-decoder is configured to decode entropy-encoded spectral values of a multi-window audio frame following a previous multi-window audio frame in dependence on a context, which context is based on a previously-decoded audio information of the previous multi-window audio frame in a non-reset state of operation;

wherein the context resetter is configured to reset the context between a decoding of entropy-encoded spectral values of subsequent audio frames in response to a one-bit context reset flag; and wherein the context resetter is configured to additionally reset, in the case of a multi-window audio frame, the context between a decoding of entropy-encoded spectral values associated with different windows of the multi-window audio frame in response to the one-bit context reset flag.

9. The audio decoder according to claim 1, wherein the audio decoder is configured to receive, as the side information for resetting the context, a one-bit context reset flag per audio frame of the encoded audio information, and to receive, as the encoded audio information, a sequence of encoded audio frames, the sequence of encoded audio frames comprising a linear-prediction-domain audio frame;

wherein the linear-prediction-domain audio frame comprises a selectable number of transform-coded-excitation portions for exciting a linear-prediction-domain audio synthesizer; and wherein the context-based entropy decoder is configured to decode spectral values of the transform-coded-excitation portions in dependence on a context, which context is based on a previously-decoded audio information in a non-reset of operation; and wherein the context-resetter is configured to reset, in response to the side information, the context to the default context before a decoding of a set of spectral values of a first transform-coded-excitation portion of a given audio frame, while omitting a reset of the context to the default context between a decoding of sets of spectral values of different transform-coded-excitation portions of the given audio frame.

10. The audio decoder according to claim 1, wherein the audio decoder is configured to receive an encoded audio information comprising a plurality of sets of spectral values per audio frame; and wherein the audio decoder is configured to also receive a grouping side information; and wherein the audio decoder is configured to group two or more of the sets of spectral values for a combination with a common scale factor information in dependence on the grouping side information;

wherein the context resetter is configured to reset the context to the default context in response to the grouping side information; and wherein the context resetter is configured to reset the context between a decoding of sets of spectral values of subsequent groups, and to avoid to reset the context between a decoding of sets of spectral values of a single group.

11. A method for providing a decoded audio information on the basis of an encoded audio information, the method comprising:

decoding the entropy-encoded audio information taking into account a context, which is based on a previously-decoded audio information in a non-reset state of operation, wherein decoding the entropy-encoded audio information comprises selecting a mapping information for deriving the decoded audio information from the encoded audio information, in dependence on the context, and using the selected mapping information for deriving a first portion of the decoded audio information; and wherein decoding the entropy-encoded audio information also comprises resetting the context for selecting the mapping information to a default context, which is independent from the previously-decoded audio information, in response to a side information, and using the mapping information, which is based on the default context, for decoding a second portion of the decoded audio information.

12. An audio encoder for providing an encoded audio information on the basis of an input audio information, the audio encoder comprising:

a context-based entropy encoder configured to encode a given audio information of the input audio information in dependence on a context, which context is based on an adjacent audio information, temporally or spectrally adjacent to the given audio information, in a non-reset state of operation;

wherein the context-based entropy encoder is configured to select a mapping information for deriving the encoded audio information from the input audio information, in dependence on the context; and wherein the context-based entropy encoder comprises a context resetter configured to reset the context for selecting the mapping information to a default context within a contiguous piece of input audio information, in response to the occurrence of a context reset condition; and wherein the audio encoder is configured to provide a side information of the encoded audio information indicating the presence of a context reset condition.

13. The audio encoder according to claim 12, wherein the audio encoder is configured to perform a regular context reset at least once per n frames of the input audio information.

14. The audio encoder according to claim 12, wherein the audio encoder is configured to switch between a plurality of different coding modes, and wherein the audio encoder is configured to perform a context reset in response to a change between two coding modes.

15. The audio encoder according to claim 12, wherein the audio encoder is configured to compute or estimate a first number of bits that may be used for encoding a certain audio information of the input audio information in dependence on a non-reset context, which non-reset context is based on an adjacent audio information, temporally or spectrally adjacent to the certain audio information, and to compute or estimate a second number of bits that may be used for encoding the certain audio information using the default context; and wherein the audio encoder is configured to compare the first number of bits and the second number of bits to decide whether to provide the encoded audio information corresponding to the certain audio information on the basis of the non-reset context or the default context, and to signal the result of said decision using the side information.

16. A method for providing an encoded audio information on the basis of an input audio information, the method comprising:

encoding a given audio information of the input audio information in dependence on a context, which context is based on an adjacent audio information, temporally or spectrally adjacent to the given audio information, in a non-reset state of operation, wherein encoding the given audio information in dependence on the context comprises selecting a mapping information, for deriving the encoded audio information from the input audio information, in dependence on the context, resetting the context for selecting the mapping information to a default context within a contiguous piece of input audio information in response to the occurrence of a context reset condition; and providing a side information of the encoded audio information indicating the presence of the context reset condition.

17. A non-transitory computer readable medium comprising, recorded thereon, a computer program for performing a method for providing a decoded audio information on the basis of an encoded audio information, the method comprising:

decoding the entropy-encoded audio information taking into account a context, which is based on a previously-decoded audio information in a non-reset state of operation, wherein decoding the entropy-encoded audio information comprises selecting a mapping information for deriving the decoded audio information from the encoded audio information, in dependence on the context, and using the selected mapping information for deriving a first portion of the decoded audio information; and wherein decoding the entropy-encoded audio information also comprises resetting the context for selecting the mapping information to a default context, which is independent from the previously-decoded audio information, in response to a side information, and using the mapping information, which is based on the default context, for decoding a second portion of the decoded audio information, when the computer program runs on a computer.

18. A non-transitory computer readable medium comprising, recorded thereon, a computer program for performing a method for providing an encoded audio information on the basis of an input audio information, the method comprising:

encoding a given audio information of the input audio information in dependence on a context, which context is based on an adjacent audio information, temporally or spectrally adjacent to the given audio information, in a non-reset state of operation, wherein encoding the given audio information in dependence on the context comprises selecting a mapping information, for deriving the encoded audio information from the input audio information, in dependence on the context, resetting the context for selecting the mapping information to a default context within a contiguous piece of input audio information in response to the occurrence of a context reset condition; and providing a side information of the encoded audio information indicating the presence of the context reset condition, when the computer program runs on a computer.

19. A non-transitory digital storage medium comprising, stored thereon, an encoded audio signal , the encoded audio signal comprising:

an encoded representation of a plurality of sets of spectral values, wherein a plurality of the sets of spectral values are encoded in dependence on an non-reset context, which is dependent on a respective preceding set of spectral values;

wherein a plurality of the sets of spectral values are encoded in dependence on a default context, which is independent from a respective preceding set of spectral values; and wherein the encoded audio signal comprises a side information signaling if a set of spectral coefficients is encoded in dependence on a non-reset context or in dependence on the default context.

* * * * *